US009465322B2

(12) United States Patent
Matsukawa et al.

(10) Patent No.: US 9,465,322 B2
(45) Date of Patent: Oct. 11, 2016

(54) CARTRIDGE AND IMAGE FORMING APPARATUS

(71) Applicant: CANON KABUSHIKI KAISHA, Tokyo (JP)

(72) Inventors: Akihisa Matsukawa, Fuchu (JP); Yusuke Usui, Tokyo (JP); Hiroyoshi Iwayama, Yokohama (JP); Takanori Watanabe, Kawasaki (JP); Naoki Okamoto, Mishima (JP); Kazuhiro Yamauchi, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/805,644

(22) Filed: Jul. 22, 2015

(65) Prior Publication Data

US 2016/0026118 A1 Jan. 28, 2016

(30) Foreign Application Priority Data

Jul. 25, 2014 (JP) ..... 2014-151312
Nov. 28, 2014 (JP) ..... 2014-241364
Jun. 26, 2015 (JP) ..... 2015-128517

(51) Int. Cl.

| | |
|---|---|
| ***G03G 15/30*** | (2006.01) |
| ***G03G 15/095*** | (2006.01) |
| ***G03G 15/02*** | (2006.01) |
| ***G03G 15/08*** | (2006.01) |
| ***G03G 21/00*** | (2006.01) |
| ***G03G 21/18*** | (2006.01) |

(52) U.S. Cl.

CPC ..... *G03G 15/095* (2013.01); *G03G 15/0233* (2013.01); *G03G 15/0818* (2013.01); *G03G 21/0064* (2013.01); *G03G 21/18* (2013.01); *G03G 21/1814* (2013.01); *G03G 21/0076* (2013.01)

(58) Field of Classification Search

CPC ..... G03G 15/095; G03G 21/18
See application file for complete search history.

(56) References Cited

U.S. PATENT DOCUMENTS 6,038,420 A * 3/2000 Hirabayashi ..... G03G 15/0216 361/225
6,212,346 B1 * 4/2001 Hirabayashi ..... G03G 15/0241 399/176

(Continued)

FOREIGN PATENT DOCUMENTS

JP 2003-162085 A 6/2003
JP 2005-173485 A 6/2005

(Continued)

OTHER PUBLICATIONS

Search Report in European Patent Application No. 15177059.1, dated Dec. 23, 2015.

*Primary Examiner* — G. M. Hyder
(74) *Attorney, Agent, or Firm* — Fitzpatrick, Cella, Harper & Scinto

(57) ABSTRACT

An image forming apparatus includes: an image bearing member; a charging member for electrically charging the image bearing member in contact with the image bearing member; and a developing member for supplying developer in contact with the image bearing member. The developer remaining on the image bearing member after transfer is collected by the developing member. A Martens hardness HMR of a surface of the charging member and a Martens hardness HMD of a surface of the developer satisfy the following relationship:

*HMD>HMR.*

43 Claims, 6 Drawing Sheets

(56) References Cited

U.S. PATENT DOCUMENTS

| | | | | |
|---|---|---|---|---|
| 6,349,182 | B2 | 2/2002 | Otsubo et al. | |
| 6,549,223 | B2 | 4/2003 | Yamauchi | |
| 6,587,659 | B2 | 7/2003 | Furuki et al. | |
| 6,674,975 | B2 | 1/2004 | Yamauchi | |
| 6,841,327 | B2 | 1/2005 | Otake et al. | |
| 6,850,714 | B2 | 2/2005 | Sakurai et al. | |
| 6,879,793 | B2 * | 4/2005 | Chiba | G03G 21/0064 399/149 |
| 6,924,076 | B2 | 8/2005 | Saiki et al. | |
| 6,963,714 | B2 | 11/2005 | Otomo et al. | |
| 7,128,211 | B2 | 10/2006 | Nishi et al. | |
| 7,233,758 | B2 | 6/2007 | Osada et al. | |
| 7,274,884 | B2 | 9/2007 | Yamauchi | |
| 7,464,520 | B2 | 12/2008 | Nishi et al. | |
| 7,639,956 | B2 | 12/2009 | Naito et al. | |
| 7,681,379 | B2 | 3/2010 | Nishi et al. | |
| 2002/0154922 | A1 * | 10/2002 | Ohno | G03G 15/0216 399/174 |
| 2003/0099487 | A1 | 5/2003 | Furuki et al. | |
| 2004/0018028 | A1 | 1/2004 | Chiba et al. | |
| 2004/0022558 | A1 * | 2/2004 | Okano | G03G 15/0208 399/175 |
| 2005/0152718 | A1 | 7/2005 | Osada et al. | |
| 2007/0292161 | A1 * | 12/2007 | Kikuchi | G03G 15/0233 399/176 |
| 2010/0075245 | A1 | 3/2010 | Watanabe et al. | |
| 2014/0051019 | A1 | 2/2014 | Sekiguchi et al. | |
| 2014/0363196 | A1 | 12/2014 | Wada et al. | |
| 2015/0125166 | A1 | 5/2015 | Matsukawa et al. | |

FOREIGN PATENT DOCUMENTS

| | | | |
|---|---|---|---|
| JP | 2006-154093 | A | 6/2006 |
| JP | 2007-264491 | A | 10/2007 |

* cited by examiner (a)

(b)

CARTRIDGE AND IMAGE FORMING APPARATUS

FIELD OF THE INVENTION AND RELATED ART

The present invention relates to an image forming apparatus for forming an image on a recording material and a cartridge detachably mountable to the image forming apparatus.

Conventionally, in an image forming apparatus of, e.g., an electrophotographic type, from the viewpoints of simplification of an apparatus constitution and elimination of a waste matter, a cleaner-less system (toner recycling system) has been proposed. This cleaner-less system is of a type in which an exclusive drum cleaner which is a cleaning means for a photosensitive drum after transfer is eliminated and a transfer residual toner on the photosensitive drum after the transfer is removed from the photosensitive drum by a developing device through "simultaneous development and cleaning" and is collected in the developing device and then is used again. The simultaneous development and cleaning is a method in which a toner remaining on the photosensitive drum after the transfer is collected by a fog-removing bias (a fog-removing potential difference Vback which is a potential difference between a DC voltage applied to the developing device and a surface potential of the photosensitive drum) during development in a subsequent step or later. According to this method, the transfer residual toner is collected in the developing device and then is used again in the subsequent step or later, and therefore a waste (residual) toner can be eliminated and it is possible to reduce a degree of troublesome handling for maintenance. Further, the cleaner-less system is employed, so that an advantage in terms of a space is large and therefore the image forming apparatus can be considerably downsized.

In the above-described cleaner-less system (toner recycling system), a contact charging type in which a photosensitive drum is electrically charged uniformly in contact with the photosensitive drum is employed in some cases. However, in the contact charging type, there is a possibility that the following problems are caused.

In the contact charging type, a charging roller is press-contacted to the photosensitive drum, and therefore when the toner remaining on the photosensitive drum after the transfer passes through a contact portion between the photosensitive drum and the charging roller, there was a possibility of generation of crack and deformation by crush of the toner between the photosensitive drum and the charging roller. The residual toner after the transfer is isolated discretely, and therefore a load exerted thereon at the contact portion between the photosensitive drum and the charging roller is large, so that the toner is liable to cause the crack and the deformation. It is difficult to uniformly impart an electric charge to an irregular-shaped toner causing the crack or the deformation, and therefore due to deteriorations in developing property, transfer property, collecting property and the like, the charging roller is contaminated with the toner, so that the charging roller is liable to cause image defect such as charging non-uniformity. Further, the irregular-shaped toner is not readily transferred, and therefore in the cleaner-less system (toner recycling system), with repetition of consumption and collection of the toner, an amount of the irregular-shaped toner in the developing device increases. As a result, with toner consumption by long-term use, image defect due to deterioration of toner flowability and failure in maintaining of toner electric charge is liable to cause.

As the cleaner-less system employing the conventional charging roller charging type, in order to solve the problems described above, three patent documents have been proposed. Japanese Laid-Open Patent Application (JP-A) 2003-162085 provides a stable image for a long term by suppressing a degree of deformation of a toner passed through a contact portion between a photosensitive drum and a charging roller. JP-A 2005-173485 and JP-A 2006-154093 define a circularity, an amount and a specific charge of a toner, and an object thereof is to suppress image defect such as a fog.

However, in constitutions of JP-A 2003-162085, JP-A 2005-173485 and JP-A 2006-154093, there is a possibility that a good image quality cannot be obtained for a long term. In JP-A 2003-162085, the degree of deformation of a toner shape is defined, but JP-A 2003-162085 merely discloses a structure of layers constituting the charging roller and that materials, thicknesses and the like of these layers are controllable by being properly selected. Further, in JP-A 2005-173485 and JP-A 2006-154093, constitutions for improving deteriorations in developing property and collecting property have been proposed, but these constitutions further leave such a problem that a durability is improved.

SUMMARY OF THE INVENTION

The present invention is a further development of the prior art constitutions. A principal object of the present invention is to provide an image stable in a quality for a long term while less causing crack and deformation of developer when the developer remaining after transfer passes through between an image bearing member and a charging member.

According to an aspect of the present invention, there is provided an image forming apparatus comprising: an image bearing member; a charging member for electrically charging the image bearing member in contact with the image bearing member; and a developing member for supplying developer in contact with the image bearing member, wherein the developer remaining on the image bearing member after transfer is collected by the developing member, and wherein a Martens hardness HMR of a surface of the charging member and a Martens hardness HMD of a surface of the developer satisfy the following relationship:

$$HMD>HMR.$$

According to another aspect of the present invention, there is provided a process cartridge detachably mountable to an image forming apparatus, comprising: an image bearing member; a charging member for electrically charging the image bearing member in contact with the image bearing member; and a developing member for supplying developer in contact with the image bearing member, wherein the developer remaining on the image bearing member after transfer is collected by the developing member, and wherein a Martens hardness HMR of a surface of the charging member and a Martens hardness HMD of a surface of the developer satisfy the following relationship:

$$HMD>HMR.$$

According to a further aspect of the present invention, there is provided a cartridge comprising: a charging member for electrically charging an image bearing member in contact with the image bearing member, wherein a Martens hardness HMR of a surface of the charging member and a Martens hardness HMD of a surface of the developer satisfy the following relationship:

$$HMD > HMR.$$

These and other objects, features and advantages of the present invention will become more apparent upon a consideration of the following description of the preferred embodiments of the present invention taken in conjunction with the accompanying drawings.

DESCRIPTION OF EMBODIMENTS

An image forming apparatus according to the present invention will be described in detail with reference to the drawings. Embodiments described in the following exemplarily illustrate the present invention, and with respect to dimensions, materials, shapes, relative arrangement and the like of constituent elements, the scope of the present invention is not intended to be limited thereto unless otherwise specified.

Figure 1:
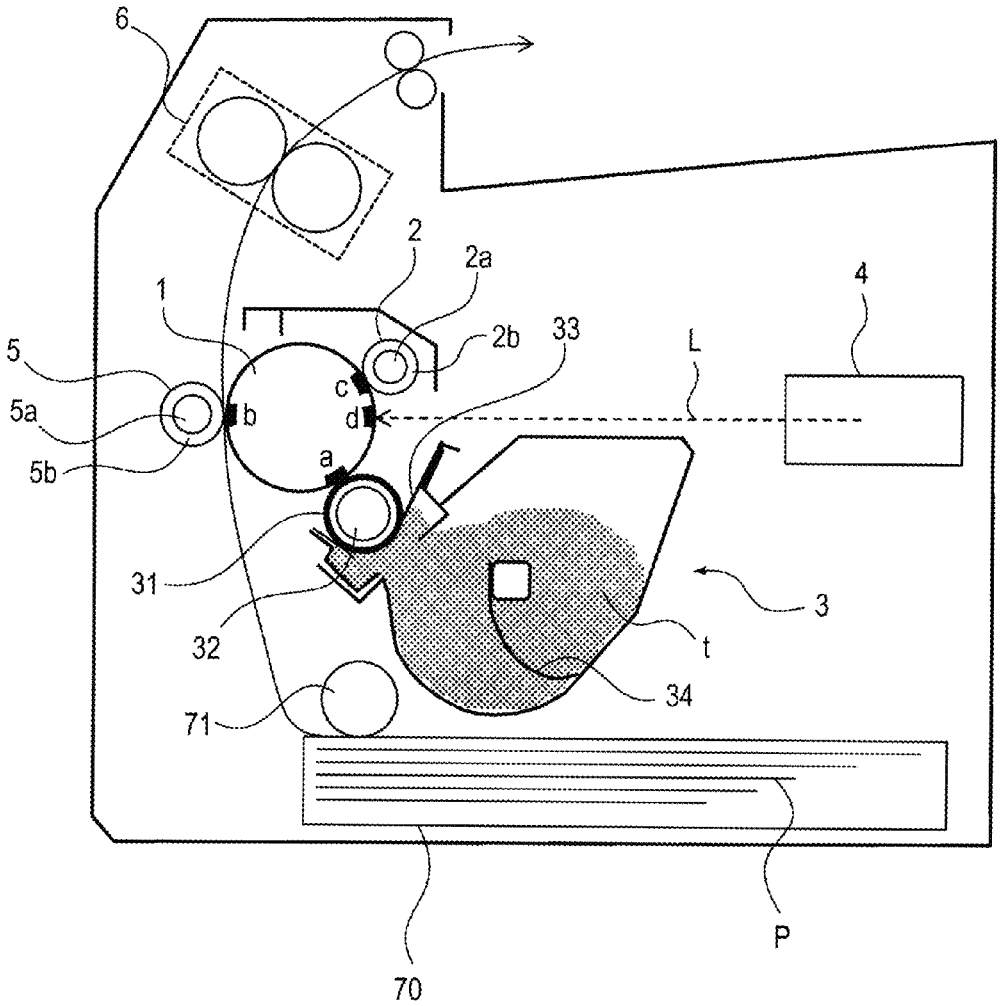
FIG. 1 is a schematic sectional view showing a structure of an image forming apparatus.

FIG. 1 is a schematic sectional view showing a structure of the image forming apparatus. The image forming apparatus shown in FIG. 1 is a monochromatic laser printer using an electrophotographic process of a transfer type.

A photosensitive drum which is an image bearing member is a negatively chargeable OPC photosensitive member of 24 mm in diameter in this embodiment. This photosensitive drum 1 is rotationally driven in the clockwise direction in the figure at a peripheral speed of 100 mm/sec (=process speed PS, printing speed) which is a certain speed.

A charging roller 2 as a charging member is provided in contact with the photosensitive drum 1, and electrically charges a surface of the photosensitive drum 1 which is an image bearing member surface. The charging roller 2 is press-contacted to the photosensitive drum 1 at a predetermined pressure (600 gf during drive in this embodiment), so that a charging nip c is formed between itself and the photosensitive drum 1. In this embodiment, the charging roller 2 is driven and rotated by rotation of the photosensitive drum 1. A charging power (voltage) source as a voltage applying means for applying a charging bias to the charging roller 2 is provided, and in this embodiment, a DC voltage is applied from the charging power source to a core metal 2*a*. The applied DC voltage is set so that a potential difference the photosensitive drum 1 surface and the charging roller 2 is discharge start voltage or more, and specifically, the DC voltage of −1300 V is applied as the charging bias. At this time, the charging roller 2 contact-charges the surface of the photosensitive drum 1 uniformly to a charge potential (dark-portion potential) of −700 V.

As an exposure means for forming an electrostatic latent image on the charged image bearing member, a laser beam scanner 4 including a laser diode, a polygon mirror and the like is used. This laser beam scanner 4 outputs laser light L modulated in intensity correspondingly to a time-series electric digital pixel signal of objective image information, and the uniformly charged surface of the photosensitive drum 1 is subjected to scanning exposure to the laser light L. In the case where the charged surface of the photosensitive drum 1 is subjected to whole surface exposure to the laser light L, laser power is adjusted so that the surface potential of the photosensitive drum 1 is −150 V.

A developing device 3 as a developing means including a developing member supplies developer to the electrostatic latent image formed on the photosensitive drum 1. The electrostatic latent image can be developed by a developing sleeve as the developing member to which a developing bias (Vdc) of −350 V is applied from a developing bias power source (unshown) as a voltage applying means for applying a voltage to the developing member.

The developing device 3 will be described. A developing sleeve 31 is rotatably supported by the developing device 3, and is rotationally driven at a peripheral speed of 140% of that of the photosensitive drum 1. The developing sleeve 31 is prepared by forming an electroconductive elastic rubber layer around a peripheral surface of a hollow aluminum bare tube, and the surface of the electroconductive elastic rubber layer has a surface roughness Ra of 1.0 μm-2.0 μm for feeding the developer. Inside the developing sleeve 31, a magnet roller 32 is fixed and disposed. A magnetic core-component black developer (negatively chargeable characteristic) T as the developer in the developing is stirred in the developing device 3 by a stirring member 34. The developer T is fed in the developing device 3 to the surface of the developing sleeve 31 by a magnetic force of the magnet roller 32 by the stirring. The developer fed to the surface of the developing sleeve 31 is uniformly formed in a thin layer by being passed through a developing blade 33 contacted to the developing sleeve 31, and is charged to the negative polarity by triboelectric charge. Thereafter, the developer on the surface of the developing sleeve 31 is fed to a developing position (contact position) where the developing sleeve 31 contacts the photosensitive drum 1, so that the electrostatic latent image on the photosensitive drum 1 is developed with the developer.

A medium-resistance transfer roller 5 as a transfer means (contact transfer means) is press-contacted to the photosensitive drum 1 at a predetermined pressure, so that a transfer nip b is formed between itself and the photosensitive drum 1. The transfer roller 5 transfers developer image, obtained by visualizing the latent image by the developing means, from the photosensitive drum 1 onto a transfer material P fed from a cassette 70 by a feeding roller 71. The transfer roller 5 used in this embodiment is prepared by forming a medium-resistance foam layer 5*b* on a core metal 5*a*, and has a roller resistance value of $5\times10^{8}\Omega$. The transfer was made by applying a voltage of +2.0 kV to the core metal 5*a*. The transfer material P fed from the cassette 70 by the feeding roller 71 is sent to the transfer nip b.

As a fixing means, a fixing device 6 of a heat fixing type is used. The transfer material P on which the toner image is transferred by being passed through the transfer nip b is separated from the surface of the photosensitive drum 1 and is introduced into the fixing device 6, so that the toner image is fixed on the transfer material P, and then the transfer material P is discharged as n image-formed product (print, copy) to an outside of the image forming apparatus.

Incidentally, in this embodiment, after the transfer by the transfer means, the developer remaining on the image bearing member is collected by the developing means simultaneously with the development. That is, a so-called cleaner-less system in which a cleaning member for removing the transfer residual toner, remaining on the photosensitive drum 1 without being transferred, from the photosensitive drum 1 is not provided is employed. In the following, the cleaner-less system in which the developer remaining on the surface of the photosensitive drum 1 after the transfer is collected using the developing sleeve 31 will be described in detail.

The transfer residual toner remaining on the photosensitive drum 1 after the transfer step is charged to the negative polarity, similarly as in the case of the photosensitive drum 1, by electric discharge at a gap portion in front of the contact portion (charging nip c) between the charging roller 2 and the photosensitive drum 1. At this time, the surface of the photosensitive drum 1 is charged to −700 V. The transfer residual toner charged to the negative polarity does not deposit on the charging roller 2 and passes through the charging nip c on the basis of a potential difference surface (photosensitive drum surface potential=−700 V, charging roller potential=−1300 V) at the charging nip c.

The transfer residual toner passed through the charging nip c reaches a laser irradiation position. The transfer residual toner is not so large in amount to the extent that it shields the laser light L of the exposure means, and therefore the transfer residual toner has no influence on the step of forming the electrostatic latent image on the photosensitive drum 1. The toner which passed through the laser irradiation position d and which is positioned at a non-exposure portion (a photosensitive drum surface which is not subjected to the laser irradiation) is collected on the developing sleeve 31 by an electrostatic force at the contact portion (developing nip a) between the developing sleeve 31 and the photosensitive drum 1. On the other hand, the toner positioned at an exposed portion (a photosensitive drum surface subjected to the laser irradiation) is not collected by the electrostatic force and continuously exists on the photosensitive drum 1. However, in some cases, a part of the toner is collected by a physical force due to a peripheral speed difference between the developing sleeve 31 and the photosensitive drum 1.

In this way, the transfer residual toner remaining on the photosensitive drum 1 without being transferred on the transfer material P is collected in the main in the developing device 3. The toner collected in the developing device 3 is mixed with the toner remaining in the developing device 3 and then is used again.

In the present invention, in order to pass the transfer residual toner through the charging nip c without being deposited on the charging roller 2, the charging roller 2 is driven and rotated with a predetermined peripheral speed difference provided in advance. By driving and rotating the charging roller 2 and the photosensitive drum 1 with the predetermined peripheral speed difference, such a toner can be charged to the negative polarity by sliding between the charging roller 2 and the photosensitive drum 1. As a result, an effect of suppressing the deposition of the toner on the charging roller 2 is achieved. In the present invention, the core metal 2*a* of the charging roller 2 is provided with a charging roller gear, and the charging roller gear engages with a drum gear provided at a photosensitive drum end portion. Accordingly, with the rotational drive of the photosensitive drum 1, also the charging roller 2 is rotationally driven. A peripheral speed of the surface of the charging roller 2 is set to be 115% of a peripheral speed of the surface of the photosensitive drum 1. Incidentally, a rotational direction of the charging roller 2 is set at the same direction as a rotational direction of the photosensitive drum 1 at a point of contact thereof with the photosensitive drum 1. Further, the peripheral speed of the charging roller 2 is effective when it is set to be 101% or more, preferably 105% or more of the peripheral speed of the surface of the photosensitive drum 1, and a practical range of the peripheral speed of the surface of the charging roller 2 is 200% or less, preferably 150% or less of the peripheral speed of the surface of the photosensitive drum 1.

In the image forming apparatus according to the present invention, the transfer residual toner is discretely scattered, and is basically isolated. For that reason, when the transfer residual toner passes through between the photosensitive drum and the charging roller, a load is exerted largely, so that there is a possibility that an irregular-shaped toner due to crack or deformation generates.

As described above, by providing the peripheral speed difference, it is possible to improve a degree of the charging of the photosensitive drum and to alleviate a degree of the deposition of the toner on the charging roller. However, from the viewpoint of the transfer residual toner, the load when the transfer residual toner passes through between the photosensitive drum and the charging roller further becomes large. In the case where the peripheral speed difference is provided, such a problem to be solved that the irregular-shaped toner generates is further caused.

When the rotational direction of the charging roller 2 is set at the same direction as the rotational direction of the photosensitive drum 1 at the contact point with the photosensitive drum 1, it is possible to further improve the degree of the charging of the photosensitive drum 1 and to further alleviate the degree of the deposition of the toner on the charging roller 2, and thus such a constitution is preferred. However, from the viewpoint of the transfer residual toner, the load when the toner passes through between the photosensitive drum and the charging roller further becomes large. For that reason, the above-described problem further becomes large.

Therefore, in the present invention, a relationship a Martens hardness HMR of the surface of the charging roller as the charging member and a Martens hardness HMD of the surface of the toner as the developer is set at HMD>HMR.

Figure 3:
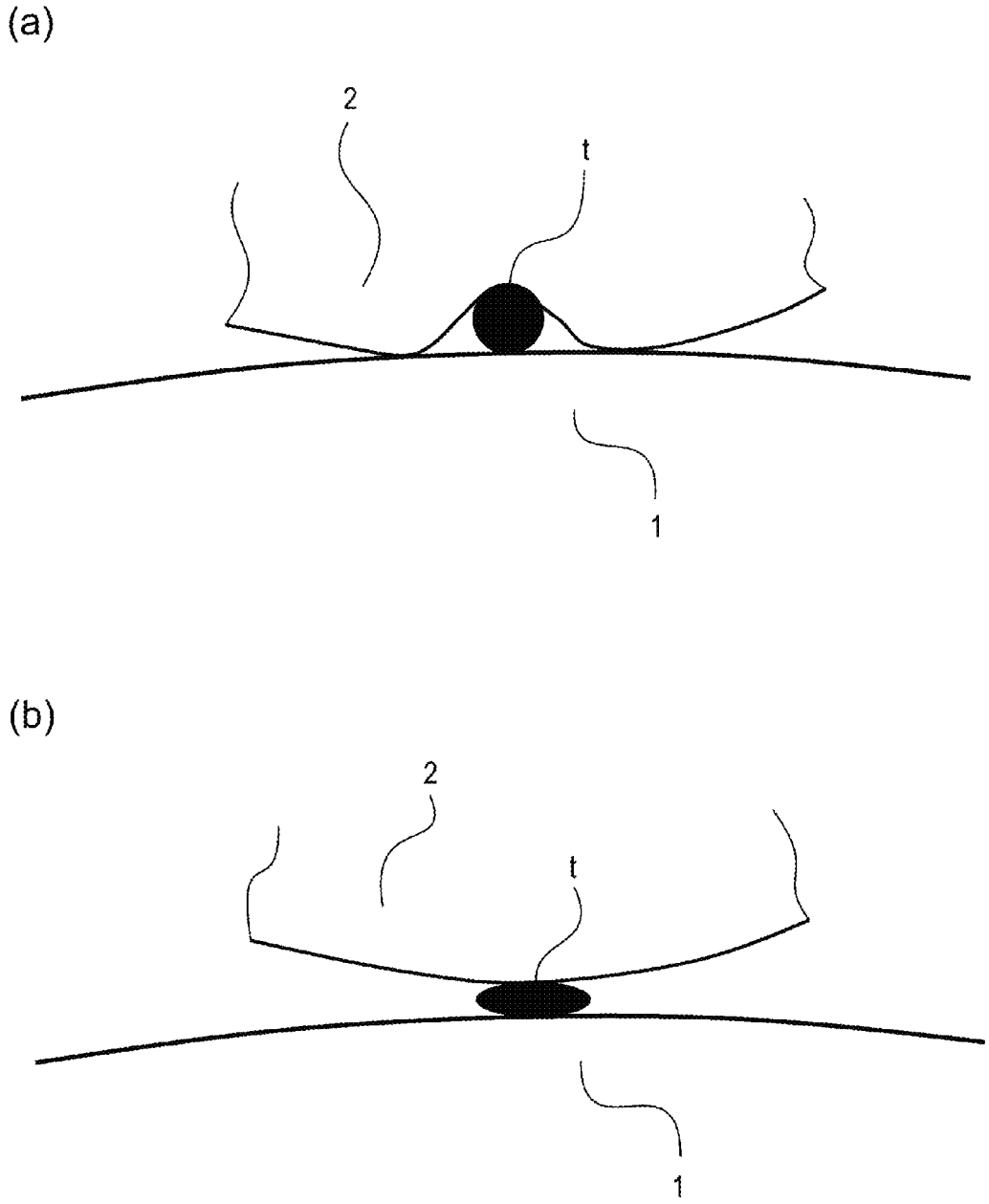
In FIG. 3, (a) and (b) are schematic views each showing deformation of the toner passing through between the charging roller and a photosensitive member.

As a result, even when the transfer residual toner passes through the contact portion between the photosensitive drum 1 and the charging roller 2, as shown in (a) of FIG. 3, the surface of the charging roller 2 is deformed earlier than the toner t. At this time, as shown in (a) of FIG. 3, the surface of the charging roller 2 deforms so that the toner t remaining on the photosensitive drum 1 bites into the charging roller 2 at the contact position (charging nip c) with the photosensitive drum 1. As a result, a degree of the deformation of the toner t is alleviated, and therefore it is possible to suppress the crack and the deformation of the toner t. On the other hand, in the case where the charging roller 2 is harder than the toner t, as shown in (b) of FIG. 3, the toner t is deformed earlier than the charging roller 2, so that the crack and the deformation of the toner t are liable to generate. Further, even under a condition in which the peripheral speed difference is provided between the photosensitive drum and the charging roller, a sufficient effect can be achieved.

Accordingly, the developer in the present invention is required to be adjusted to have the predetermined Martens hardness as described above. In the case where a negatively chargeable magnetic one-component toner is used as the developer, the toner can be manufactured in the following manner.

In the present invention, the Martens hardness which is a very small pressing depth of 1 μm is controlled. In order to obtain the developer suitable for the present invention, a hardness of particles constituting the developer, i.e., a hardness of magnetic one-component toner particles contained in the developer is required to be controlled in the above case.

In order to obtain the magnetic one-component toner having a desired Martens hardness, the following methods can be used. As one of the methods, it is possible to cite a method in which a material, a composition, a molecular weight and the like of a binder resin for the magnetic one-component toner is controlled. Further, it is possible to cite a method in which the control is effected by appropriately provide a shell layer at a surface of a base material of the magnetic one-component toner. Further, the control can be effected by appropriately selecting materials, to be incorporated in the magnetic one-component toner particles, including a softening material such as a wax or a material such as an inorganic pigment including a colorant or magnetic powder.

When the Martens hardness HMD of the toner surface is excessively small, there is a possibility that a depositing force becomes large and thus the toner is not readily used. Further, when the Martens hardness HMD of the toner surface is excessively large, the toner is liable to cause such a disadvantage that the photosensitive drum is damaged. Accordingly, from the viewpoint of the depositing force, the Martens hardness HMD of the toner surface may preferably be 2 or more, further preferably be 2.5 or more. Further, in a relationship with the photosensitive drum surface layer, the Martens hardness HMD of the toner surface may preferably be used in a range of 50 or less, more preferably 20 or less, further preferably 15 or less.

On the other hand, also the charging roller used in the image forming apparatus of the present invention is required to have a predetermined Martens hardness. In order to provide the charging roller with the predetermined Martens hardness, it is possible to cite, e.g., a method in which a material, a composition, a molecular weight, a degree of cross-linking and the like for a surface layer of the charging roller and the neighborhood thereof is controlled. Further, the control can also be effected by incorporating a hard or soft material in the surface layer of the charging roller.

When the Martens hardness HMR of the charging roller surface is excessively small, there is a possibility that a tack property becomes high and a torque becomes large and thus the toner is not readily used. Further, when the Martens hardness HMR of the charging roller surface is excessively large, there is a possibility that such a disadvantage that the photosensitive drum is damaged is caused. Accordingly, from the viewpoints of the tack property and the torque, the Martens hardness HMR of the charging roller surface may preferably be used in a range of 0.5 or more, further preferably 1 or more. Further, from the viewpoint that the photosensitive drum is damaged, the Martens hardness HMR of the charging roller surface may preferably be 19 or less, further preferably be 10 or less.

Further, when a arithmetic average roughness Ra of the charging roller surface is excessively small, there is a possibility that the tack property becomes high and the torque becomes large and thus the toner is not readily used. Further, when the arithmetic average roughness Ra of the charging roller surface is excessively large, surface hardness non-uniformity of the charging roller generates, so that there is a possibility that the toner cracks. Accordingly, from the viewpoints of the tack property and the torque, the arithmetic average roughness Ra may preferably be used in a range of 0.1 μm or more, move preferably 0.6 μm or more. Further, from the viewpoint of the charging roller surface hardness non-uniformity, the arithmetic average roughness Ra may preferably be used in a range of 10 μm or less, more preferably 5 μm layer. Further, a difference in Martens hardness between the toner and the charging roller may preferably be used in a range of 1 or more, more preferably 3 or more. Incidentally, the arithmetic average roughness Ra described above is measured according to JIS B0601:2001.

Toners and charging rollers used in Embodiments of the present invention and Comparison Examples are prepared in the following manners. In the following, Manufacturing Embodiments of the toners and the charging rollers will be exemplarily described.

Toner Manufacturing Embodiment 1

| | |
|---|---|
| Styrene | 75 weight parts |
| n-Butyl acrylate | 25 weight parts |
| Divinylbenzene | 0.5 weight part |
| Saturated polyester (reaction product of terephthalate acid and ethylene oxide adduct of bisphenol A, number-average molecular weight = 4000, Mw/Mn = 2.8, acid value = 11 mg/KOH) | 8 weight parts |
| Magnetic powder (S-treated with n-hexylmethoxysilane, volume-average particle size: 0.2 μm, saturation magnetization: 70 $Am^2/kg$ under magnetic field of 79.6 kA/m) | 80 weight parts |
| Resin having sulfonic group (copolymer of 83 weight parts of styrene, 12 weight parts of n-butyl acrylate and 5 weight parts of 2-methylpropanesulfonate, weight-average molecular weight: 23000) | 1.5 weight parts |
| Paraffin wax (maximum endothermic peak (temperature) in DSC: 78° C.) | 10 weight part |
| Polymerization initiator (2,2'-azobis(2,4-dimethylvaleronitrile) | 5 weight parts |

The above mixture was uniformly dissolved and dispersed in accordance with a usual method, and in the mixture, 750 weight parts of ion-exchanged water containing a dispersant was poured, so that particles were formed. Thereafter, reaction, cooling and removal of the dispersant were made and then the reaction product was dried to obtain a toner base material. Incidentally, the thus-prepared toner base material includes a polyester layer as a surface layer thereof.

To 100 weight parts of the toner base material, 1.0 weight part of hydrophobic silica fine particles of 120 $m^2/g$ in BET value is externally added, so that a magnetic toner of 7.9 μm in weight-average particle size was obtained. An average circularity of the magnetic toner is 0.975. When the Martens hardness of the magnetic toner in this Manufacturing Embodiment was measured, the Martens hardness (HMD) was 1.1.

Toner Manufacturing Embodiment 2

A toner base material was obtained in the same manner as in Toner Manufacturing Embodiment 1 except that the weight amount of the saturated polyester resin in Toner Manufacturing Embodiment 1 was changed to 3 weight parts.

To 100 weight parts of the toner base material, 1.0 weight part of hydrophobic silica fine particles of 120 $m^2/g$ in BET value is externally added, so that a magnetic toner of 7.5 μm in weight-average particle size was obtained. An average circularity of the magnetic toner is 0.977. When the Martens hardness of the magnetic toner in this Manufacturing Embodiment was measured, the Martens hardness (HMD) was 5.0.

Toner Manufacturing Embodiment 3

| | |
|---|---|
| Styrene | 80 weight parts |
| n-Butyl acrylate | 20 weight parts |
| Polymethacrylate macromer (Mn = 6000) | 0.3 weight part |
| Divinylbenzene | 0.3 weight part |
| Magnetic powder (S-treated with n-hexylmethoxysilane, volume-average particle size: 0.2 μm, saturation magnetization: 70 $Am^2/kg$ under magnetic field of 79.6 kA/m) | 80 weight parts |
| Resin having sulfonic group (copolymer of 83 weight parts of styrene, 12 weight parts of n-butyl acrylate and 5 weight parts of 2-methylpropanesulfonate, weight-average molecular weight: 23000) | 1.0 weight part |
| Dipentaerythritolhexamyristate (maximum endothermic peak (temperature) in DSC: 66° C.) | 6 weight part |
| Polymerizationinitiator(t-butylperoxy-isobutylate) | 6 weight parts |

The above mixture was uniformly dissolved and dispersed in accordance with a usual method, and in the mixture, 750 weight parts of ion-exchanged water containing a dispersant was poured, so that particles were formed. Thereafter, reaction was made to obtain a toner slurry.

The following ingredients were mixed to obtain a water-methylmethacrylate dispersion.

| | |
|---|---|
| Methylmethacrylate | 2 weight parts |
| Ion-exchanged water | 65 weight parts |

In the resultant slurry, the following ingredients were added, so that reaction was caused. Around the resultant toner base particles, a layer of polymethylmethacrylate is formed.

| | |
|---|---|
| Water-methylmethacrylate dispersion described above | 67 weight parts |
| 2,2-azobis[2-methyl-N-(2-hydroxyethyl)-propionamide] | 0.3 weight part |

To 100 weight parts of the toner base material, 1.0 weight part of hydrophobic silica fine particles of 120 $m^2/g$ in BET value is externally added, so that a magnetic toner of 7.6 μm in weight-average particle size was obtained. An average circularity of the magnetic toner is 0.972. When the Martens hardness of the magnetic toner in this Manufacturing Embodiment was measured, the Martens hardness (HMD) was 2.1.

Toner Manufacturing Embodiment 4

A toner having the Martens hardness (HMD) of 19 was manufactured by a suspension polymerization method in the following manner.

A toner base material was obtained in the same manner as in Toner Manufacturing Embodiment 1 except that the weight amount of the saturated polyester resin in Toner Manufacturing Embodiment 1 was changed to 15 weight parts.

To 100 weight parts of the toner base material, 1.0 weight part of hydrophobic silica fine particles of 120 $m^2/g$ in BET value is externally added, so that a magnetic toner of 7.8 μm in weight-average particle size was obtained. When the Martens hardness of the magnetic toner in this Manufacturing Embodiment was measured, the Martens hardness (HMD) was 19.

Charging Roller Manufacturing Embodiment 1

| | |
|---|---|
| Butadiene-acrylnitrile rubber (trade name: "Nipol DN-219", manufactured by Zeron Corp.) | 100 weight parts |
| Plasticizer (sebacic acid-polypropylene glycol copolymer: Mn = 8000) | 7 weight parts |
| Stearic acid | 1.2 weight parts |
| Zinc oxide | 5 weight parts |
| Carbon black (tradename: "TOKABLACK #7360SB", manufactured by Tokai Carbon Co.,Ltd.) | 45 weight parts |

The above ingredients were mixed by a mixer, and in the resultant mixture, the following ingredients were kneaded by open rolls, so that an NBR kneaded material was obtained.

| | |
|---|---|
| Sulfur | 1 weight part |
| Tetrabenzylthiuram disulfide | 3 weight parts |

Then, the NBR kneaded material was extruded in a cylindrical shape of 10.5 mm in outer diameter and 4.5 mm in inner diameter by an extruding machine. Then, the cylindrical kneaded material was cut in a length of 250 mm, and then was primary-vulcanized for 40 minutes in water vapor at a temperature of 160° C. using a vapor vulcanizing pan, so that a primary-vulcanized rubber tube for an electroconductive elastic layer was obtained.

Then, a thermosetting adhesive was applied onto a central portion of 231 mm in length of a steel-made cylinder (having a nickel-plated surface) of 5 mm in diameter and 256 mm in length, and then dried at 80° C. for 10 minutes to obtain an electroconductive support. The electroconductive support was then inserted into the primary-vulcanized rubber tube, followed by heating for 1 hour in an electric oven at 150° C. to obtain an un-abraded roller.

A rubber portion of the un-abraded roller was cut at end portions thereof in a length of 232 mm, and then was abraded by a grindstone, so that an electroconductive base material of 9 mm in diameter was prepared.

| | |
|---|---|
| 8-nylon (N-methoxymethylated nylon, trade name "Toresin EF30T", manufactured by Teikoku Kagaku Sangyo K.K.) | 100 weight parts |
| Carbon black (trade name: "DENKA BLACK" (registered trademark), manufactured by Denki Kagaku Kogyo K.K.) | 10 weight parts |
| Citric acid | 1 weight part |
| Methanol | 350 weight parts |
| Toluene | 150 weight parts |

The above ingredients were dispersed and mixed by a hall mill, and then filtered to obtain a coating liquid.

The coating liquid was coated on the electroconductive base material by a roll coating method and was air dried, and thereafter was dried in a condition of 60° C. and 1 hour, followed by cross-linking reaction at 130° C. for 30 minutes, so that a 15 μm-thick surface layer was formed.

A charging roller manufactured in this Manufacturing Embodiment had the Martens hardness (HMR) of 3.0 and an MD-1 hardness of 62. The arithmetic average roughness Ra of the charging roller is 2.1 μm.

Charging Roller Manufacturing Embodiment 2

A charging roller 2 including a 13 μm-thick surface layer was obtained in the same manner as in Charging Roller Manufacturing Embodiment 1 except that the weight amount of citric acid in Charging Roller Manufacturing Embodiment 1 was changed to 0.5 weight part.

The charging roller 2 in this Manufacturing Embodiment had the means (HMR) of 2.5 and the MD-1 hardness of 62. The arithmetic average roughness Ra of the charging roller 2 is 2.0 μm.

Charging Roller Manufacturing Embodiment 3

An electroconductive base material was obtained in the same manner as in Charging Roller Manufacturing Embodiment 1.

| | |
|---|---|
| Acrylic silicone polymer (trade name: MODIPER FS700", manufactured by NOF Corp. | 100 weight parts |
| Carbon black (trade name: "DENKA BLACK" (registered trademark), manufactured by Denki Kagaku Kogyo K.K.) | 40 weight parts |
| Ethyl acetate | 500 weight parts |

The above ingredients were dispersed and mixed by a hall mill, and then filtered to obtain a dispersion. Into the dispersion, the following ingredient was added and mixed to obtain a coating liquid.

| | |
|---|---|
| Diphenylmethane diisocyanate | 10 weight parts |

The coating liquid was coated on the electroconductive base material by a roll coating method and was air dried, and thereafter was dried at 120° C. and 1 hour. A surface layer has a thickness of 20 μm.

A charging roller manufactured in this Manufacturing Embodiment had the Martens hardness (HMR) of 13.4 and an MD-1 hardness of 61. The arithmetic average roughness Ra of the charging roller is 2.1 μm.

The average circularity in the present invention is used as a simple method for quantitatively representing a particle shape, and in the present invention, the particle shape is measured using a flow-type particle image analyzer ("FPIA-2100", manufactured by Sysmex Corp.), so that the circularity is obtained by formula 1 shown below. Further, as shown by formula 2 below, a value obtained by dividing the sum of values of the circularity of all of measured particles by the number of all the particles is defined as the average circularity.

Circularity($Ci$)=(circumferential length of circle having the same projected area as the number of particles)/(circumferential length of projected image of particle) formula 1.

$$(\overline{C}) = \sum_{i=m}^{m} Ci/m. \quad \text{formula 2}$$

Incidentally, in "FPIA-2100" used as a measuring device in the present invention, first, the circularity of each of the particles is calculated. After the calculation, for calculation of the average circularity, a calculating method in which the circularity from 0.400 to 1.000 is divided into ranges divided with a predetermined increment depending on the obtained circularity of the particles and then the average circularity is calculated using a center value and a frequency of each of the divided ranges is used. Specifically, the circularity from 0.400 to 1.000 is divided with an increment of 0.010 into 61 divided ranges starting from a range of 0.400 or more and less than 0.410, a range of 0.410 or more and less than 0.420, . . . a range of 0.990 or more and less than 1.000, and 1.000.

An error between each of respective values of the average circularity calculated by the above calculating method and each of respective values of the average circularity calculated by the calculating method directly using the above-described circularity of each of the particles is very small, and is at a substantially negligible level. For that reason, in the present invention, for reason of data processing such as shortening of a calculation time or simplification of an operational expression for the calculation, such a calculating method that a concept of a calculating formula directly using the circularity of each of the particles described above is used and is partly changed is employed.

The toner used in the image forming apparatus according to the present invention may preferably have a high circularity. Specifically, this is because when the circularity is 0.960 member, preferably 0.970 or more, a transfer performance is high and thus an image with less fog is easily obtained.

Further, the toner used in the present invention may preferably be used when a weight-average particle size is 4-9 μm, so that a high-definition image can be obtained. The weight-average particle size in the present invention is measured in the following manner.

As a measuring apparatus, e.g., a Coulter Counter TA-II or Coulter II (manufactured by Coulter Inc.) or a Coulter Multisizer III (manufactured by Beckman Coulter K.K.) is used. As an electrolytic (aqueous) solution, about 1%-NaCl aqueous solution prepared by using a first class grade sodium chloride, such as ISOTON-II (manufactured by Coulter Scientific Japan Ltd.), is used.

As a measuring method, 0.1 ml of a surfactant (preferably alkyl-benzene sulfonate) is added, as dispersant, into 100 ml of above-mentioned electrolytic aqueous solution. Then, 5 mg of a measurement sample (toner or toner particles) was added to the above mixture. Then, the electrolytic aqueous solution in which the sample was suspended is subjected to dispersion by an ultrasonic dispersing device for about 1 minute. Then, the volume and the number of the toner particles are measured every channel with the use of the measuring apparatus fitted with a 100 μm-aperture as an aperture, thus calculating a volume distribution and a number distribution. A weight-bias weight-average particle size D4 (μm) of the toner obtained from the volume distribution of the toner particles is obtained.

<Measuring Method of Martens Hardness>

For measurement of the Martens hardness HM, a measuring device ("FISCHERSCOPE HM2000S, manufactured by Fischer Instruments K. K.) is used.

The Martens hardness HM is measured in a state in which a test load is imposed. The Martens hardness HM is obtained from a value obtained from a load and a depth of a recess after the test load is increased to reach a predetermined load if possible. Specifically, the Martens hardness HM is measured in the following manner.

The Martens hardness HM is defined as a quotient of an imposed testing force (F) divided by a surface area As(h) of the recess, and the surface area As(h) of the recess is calculated from an indenter (penetrator) indentation depth (h). As the indenter, Vickers indenter is used.

$$HM=F/As(h)=F/(26.43\times h_2) \quad \text{formula 3}$$

The measuring device is set so that a maximum indentation depth $h_2$ is 0.002 mm, a maximum test load Fmax is 0.2 mN, and a test time is 30 sec.

From the thus-obtained test load in the indentation depth of 1 μm, by the above formula 3, the Martens hardness HM in the present invention can be obtained. Incidentally, in the present invention, the Martens hardness of the toner surface obtained by the formula 3 is HMD, and the Martens hardness of the charging roller surface obtained by the formula 3 is HMR.

More specifically, the toner surface Martens hardness HMD and the charging roller surface Martens hardness HMR in the present invention are measured in the following manner.

a) Method: according to ISO 14577-1 b) Material and shape of indenter: Vickers indenter, face angle=136, Young's modulus=1140, Poisson's ratio=0.07, HV=0.0945XHIT c) Method used for determining zero point: Glass REFERENCE d) Temperature/humidity during test: 23° C./50% RH e) Analyzing method: HM2000S, WIN-HCU software Incidentally, in the measurement of the toner surface Martens hardness HMD, the measurement is made in a state in which the latent image is developed into the toner image on the image bearing member. At this time, the toner surface Martens hardness is measured every one toner particle on the image bearing member while observing the toner particle through a microscope. A measuring sample are arbitrarily selected 50 toner particles, and an average of 50 measured values was used as the toner surface Martens hardness.

On the other hand, the charging roller surface Martens hardness HMR was obtained by being measured at 50 parts arbitrarily selected from a region corresponding to a charging roller portion used for forming the image and then by calculating an average of 50 measured values.

Incidentally, in the present invention, the Martens hardness is calculated from the load when the indentation depth reaches 0.001 mm. A unit of the Martens hardness in the present invention is $N/mm^2$. A feature of the present invention is that the hardness at this extreme surface is noted.

For example, when the indentation depth is excessively made large, e.g., in the neighborhood of 7 μm, minute difference in hardness of the charging roller surface layer cannot be distinguished, so that values with no difference are measured. For that reason, discrimination of the toner crack in this embodiment cannot be made. Further, the particle surface of the toner is depressed, so that there is a possibility that the Martens hardness is unmeasurable. Accordingly, the indentation depth for measurement may preferably be about 0.001 mm.

Further, similarly also in measurement of an MD1 hardness, the indentation depth becomes excessively deep, and thus a difference in hardness at the extreme surface of the charging roller cannot be measured, and therefore the problem of the present invention cannot be led to be solved. In the present invention, the MD1 hardness is measured by a measuring method commonly used by a person skilled in the art. Specifically, the MD1 hardness is a hardness measured using an Asker micro-rubber hardness meter ("MD-1 type A" (trade name), manufactured by Kobunshi Keiki Co., Ltd.). In the present invention, a charging member left standing for 12 hours or more in an environment of normal temperature/normal humidity (23° C./50% RH) is subjected to measurement in an operation in a peak hold mode of 10N by this hardness meter, and the thus-obtained value is used as the MD1 hardness.

Further, in the present invention, a relationship among a contact position between the photosensitive drum 1 and the charging roller 2, a contact position between the photosensitive drum 1 and the developing sleeve 31 and a contact position between the developing sleeve 31 and the developing blade 33 is a positional relationship shown in FIG. 1. That is, the relationship among these contact positions in the order of the contact position between the photosensitive drum 1 and the charging roller 2, the contact position between the photosensitive drum 1 and the developing sleeve 31 and the contact position between the developing sleeve 31 and the developing blade 33 from above with respect to the direction of gravity.

Further, the present invention is not restricted to the image forming apparatus in which the image bearing member, the charging member and the developing means are independently exchangeable. For example, the present invention is also effective when the present invention is applied to a process cartridge detachably mountable to the image forming apparatus. The process cartridge integrally holds at least the image bearing member, the charging member and the developing means and is made detachably mountable to the image forming apparatus, so that the process cartridge is easily exchangeable by the user. Further, when the Martens hardness of the surface of the charging member is HMR and the Martens hardness of the surface of the developer is HMD, the relationship of HMD>HMR is satisfied, so that similarly as in the case where the present invention is applied to the image forming apparatus, it is possible to obtain an image having a stable image quality for a long term.

Embodiment 1

Evaluation was made using the image forming apparatus described above and using the charging roller of [Charging Roller Manufacturing Embodiment 1] as the charging roller and the toner of [Toner Manufacturing Embodiment 1] as the toner.

Durability evaluation was made by filling 100 g of the toner in the developing device in an evaluation environment of 23° C. in temperature and 50% in humidity and then by effecting printing of 3000 A4-sized sheets with a print ratio of 1.5%.

Evaluation items are an image quality, a fog on the drum and toner shape observation on the developing sleeve at that time. The toner shape observation is made through an electron microscope. An effect is measured by a ratio (proportion) of the number of toner particles recognized as an irregular shape to the number of the entirety of the toner particles.

The evaluation result is as shown in Tables 1 and 2 shown below. In a constitution in which the charging roller Martens hardness is 3 and the toner Martens hardness is 11, there was substantially no crack of the toner on the developing sleeve and the fog on the photosensitive drum was 4%, so that the image4 quality was good.

TABLE 1

| Comparison sample | Martens hardness ($N/mm^2$) Charging roller | Toner |
|---|---|---|
| EMB 1 | 3 | 11 |
| EMB 2 | 13.4 | 19.1 |
| EMB 3 | 2.5 | 5 |
| COMP. EX. 1 | 13.4 | 11 |
| COMP. EX. 2 | 3 | 2.1 |

Table 2

| Comparison sample | Durability result of 3000 sheets TO*1 | Fog*2 (%) | IQ*3 |
|---|---|---|---|
| EMB. 1 | SNC | 4 | o |
| EMB. 2 | SNC | 4 | o |
| EMB. 3 | SNC | 5 | o |
| COMP. EX. 1 | HC | 24 | IC |
| COMP. EX. 2 | HC | 20 | IC |

*1"TO" represents toner observation on the developing sleeve.
"SNC" means that there was substantially no crack of the toner particles.
"HC" means that approximately half of the toner particles cracked.
*2"Fog" represents the fog (%) on the photosensitive drum.
"IQ" represents the image quality.
"o" means that the image quality was good.
"IC" means that the improper charging generated.

Figure 2:
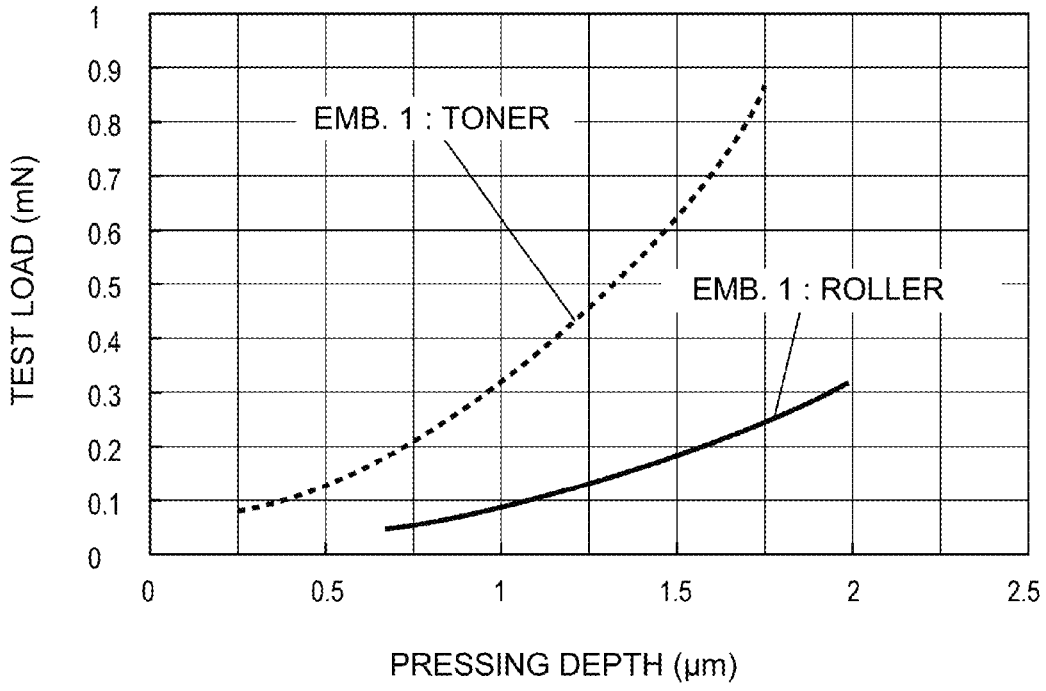
FIG. 2 is a graph showing a load-pressing depth curve of each of a charging roller and a toner in Embodiment 1.

Incidentally, an example of a load-recess depth curve when the Martens hardness of each of the charging roller and the toner was measured is shown in FIG. 2. In FIG. 3, the charging roller Martens hardness is represented by a solid line, and the toner Martens hardness is represented by a broken line.

Figure 4:
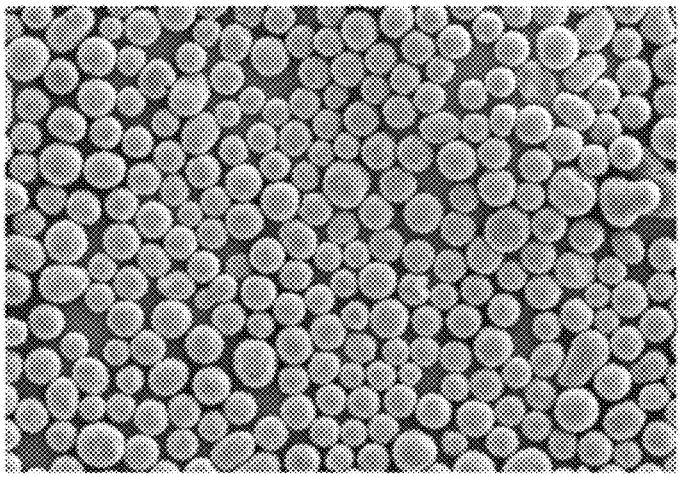
In FIG. 4, (a) and (b) are illustrations each showing a toner observation image after accelerated evaluation in Embodiment 1 and Comparison Example 1, respectively.
Figure 4:
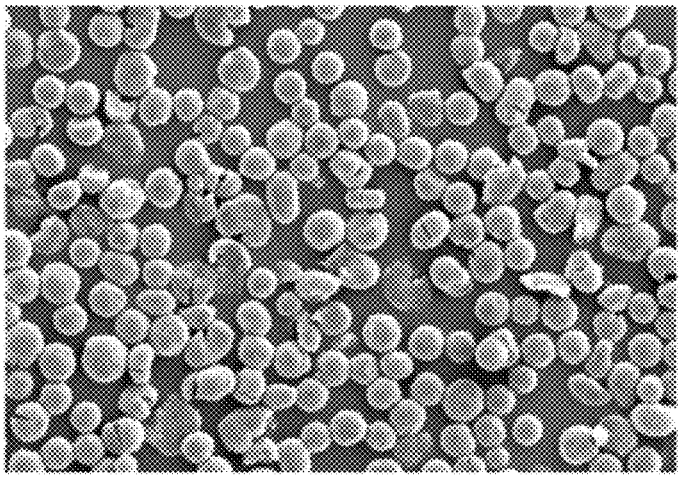

Separately from the durability evaluation, an acceleration evaluation for checking crack and deformation of the toner simply is also made. In an acceleration evaluation method, evaluation of the toner is made using the image forming apparatus described in each of Embodiments and Comparison Examples. First, a toner intended to be evaluated is used to develop an electrostatic latent image for a solid block image (m/s=about 8 $g/m^2$) of 25 mm in length with respect to a circumferential direction of the photosensitive drum, thus being placed on the photosensitive drum. In this case, a charging roller intended to be evaluated is used. Thereafter, the developing device is demounted, and idling is performed for 12 minutes. After a lapse of 12 minutes, the toner deposited on the charging roller is observed. The observation of the toner shape is made through the electron microscope, and an effect is checked by a proportion (ratio) of the number of toner particles recognized as being an irregular shape per the number of the entirety of the toner particles. As an example, the acceleration evaluation is made in each of the constitution of Embodiment 1 and the constitution of Comparison Example 1 in Table 1, and images taken through the electron microscope are shown in (a) and (b) of FIG. 4, respectively. In the constitution of Embodiment 1, as shown in (a) of FIG. 4, it was able to be confirmed that most of the toner particles are maintained in a spherical state. Further, in the constitution of Comparison Example 1, as shown in (b) of FIG. 4, the crack and deformation of the toner particles were able to be confirmed.

Embodiment 2

Durability evaluation was made using a charging roller of [Charging Roller Manufacturing Embodiment 3] as the charging roller and a toner of [Toner Manufacturing Embodiment 4] as the toner similarly as in Embodiment 1. The evaluation result is shown in Tables 1 and 2. In the constitution in which the charging roller Martens hardness is 13.4 and the toner Martens hardness is 19.1, there was substantially no crack of the toner on the developing sleeve and the fog on the photosensitive drum was 4%, so that the image quality was good.

Embodiment 3

Durability evaluation was made using a charging roller of [Charging Roller Manufacturing Embodiment 2] as the charging roller and a toner of [Toner Manufacturing Embodiment 2] as the toner similarly as in Embodiment 1. The evaluation result is shown in Tables 1 and 2. In the constitution in which the charging roller Martens hardness is 2.5 and the toner Martens hardness is 5, there was substantially no crack of the toner on the developing sleeve and the fog on the photosensitive drum was 4%, so that the image quality was good.

Comparison Example 1

Durability evaluation was made using a charging roller of [Charging Roller Manufacturing Embodiment 3] as the charging roller and a toner of [Toner Manufacturing Embodiment 1] as the toner similarly as in Embodiment 1. The evaluation result is shown in Tables 1 and 2. In the constitution in which the charging roller Martens hardness is 13.4 and the toner Martens hardness is 11, about half of the toner particles on the developing sleeve cracked and the fog on the photosensitive drum was 24%, so that the image quality was improper charging.

Comparison Example 2

Durability evaluation was made using a charging roller of [Charging Roller Manufacturing Embodiment 1] as the charging roller and a toner of [Toner Manufacturing Embodiment 3] as the toner similarly as in Embodiment 1. The evaluation result is shown in Tables 1 and 2. In the constitution in which the charging roller Martens hardness is 3 and the toner Martens hardness is 2.1, about half of the toner particles on the developing sleeve cracked and the fog on the photosensitive drum was 20%, so that the image quality was improper charging.

Effect of the Present Invention

The evaluation of the toner crack, the fog and the image quality was made using the constitution of Embodiment 1 satisfying the relationship of HMD (toner surface Martens hardness)>HMR (charging roller surface Martens hardness) and the constitution of Comparison Examples 1 and 2 which do not satisfy the relationship. In Comparison Example 1 as a comparison sample of Embodiment 1, the constitution in which only the charging roller is increased in hardness of the charging roller in the constitution of Embodiment 1 is employed, and in Comparison Example 2, the constitution in which only the toner is increased in hardness of the toner in the constitution of Embodiment 1.

Further, with respect to Embodiments 2 and 3, the hardness is changed to an upper side and a lower side within a range satisfying the condition of HMD>HMR described above, and then the evaluation is made.

As described above, in Embodiment 1, even at the time of 3000 sheets, there is substantially no crack of the toner and the amount of the fog toner is small, and therefore a stable image quality can be maintained without contaminating the charging roller. On the other hand, in Comparison Examples 1 and 2, at the time of 3000 sheets, the fog was worsened and the amount of the toner deposited on the charging roller increased, so that the improper charging was caused to generate. Further, on the developing sleeve, about half of the cracked toner particles were observed. This is because in the constitutions of Comparison Examples 1 and 2, the toner cracks between the charging roller and the photosensitive member and the cracked toner is collected in the developing container. Accordingly, with respect to the toner in the developing container, the proportion of the cracked toner increase with use for a long term, and also with respect to the toner on the particle size, the proportion of the cracked toner increases. For that reason, the toner to which a sufficient electric charge is not imparted becomes large in amount, so that the fog toner on the photosensitive member increases. The fog toner is not readily charged to the negative polarity, and therefore is not transferred but is deposited on the charging roller, thus causing the improper charging.

Further, as in Embodiments 2 and 3, even when the hardness is changed to the upper side and the lower side, in the case where the charging roller and the toner which satisfy the above-described condition of HMD>NMR, the stable image quality was obtained in the durability test of 3000 sheets.

As described above, the charging roller having the Martens hardness HMR smaller than the toner surface Martens hardness HMD is used. As a result, between the charging roller and the photosensitive drum, the cracked and deformation of the toner can be suppressed, so that a degree of the fog can be maintained at a satisfactory level and the good image can be obtained through the durability test.

The Martens hardness relationship is a relationship between the hardness values in a surface region in a nanometer unit. With respect to the toner, surface strength per one particle is measured, and therefore a side of the surface region may preferably be 700 nm or less (0.7 μm or less). In the Martens hardness, the pressing strength is measured, and therefore the Martens hardness is the hardness from the surface of the surface layer to a depth of 700 nm or less from the surface. When the toner is small, the range becomes further small.

As described above, in this embodiment, the magnetic spherical toner prepared by a suspension polymerization method is used, but a usable toner is not restricted thereto. The present invention can also be similarly applied to also other toners manufactured by known manufacturing methods such as a pulverizing method and a method of manufacturing toner particles by agglomerating emulsified particles. Further, the toner is not limited to the magnetic toner, but the present invention is applicable to also a non-magnetic toner.

In this embodiment, an example of a one-component developing method was showed, but it is also possible to employ another known developing method such as a so-called two-component developing method.

As described hereinabove, according to the present invention, even when the developer remaining on the image bearing image bearing member after the transfer passes through between the image bearing member and the charging member, the charging member is softer than the developer and therefore is easily deformed, so that a load imposed on the developer is alleviated. For this reason, it becomes possible to suppress the crack and the deformation of the developer.

For that reason, in a so-called cleaner-less system in which the developer remaining on the image bearing member after the transfer is collected by the developing member, an image defect such as the fog is suppressed, so that it is possible to obtain an image which is stable in image quality for a long term.

Embodiment 4

In the above-described embodiments, the comparison with the toner was made using the average of the charging roller. However, there is a variation in hardness in actuality, so that there is also a distribution of the charging roller hardness. For that reason, even when the average of the charging roller is made softer (smaller) than the average of the toner, depending on a distribution of the charging roller, a portion harder than the toner exists in a large amount, so that the portion is liable to cause the crack and the deformation of the toner.

Therefore, in Embodiment 4, also a variation in hardness of the charging roller is taken into consideration, and the Martens hardness HMD of the surface of the toner as the developer is set at a value higher than a value of (HYMR+3σ) with respect to the Martens hardness HMR of the surface of the charging roller as the charging member (HMD>HMR+3σ). As a result, the crack, the deformation and the like of the toner are suppressed for a long term, so that the degree of fog deterioration is alleviated and thus stabilization of the image quality can be realized.

In Embodiment 4, the charging roller Martens hardness is controlled in terms of a distribution thereof. For comparison, Comparison Example 3 satisfying only the above-described condition of MHD>HMR and Embodiment 4 satisfying both of the conditions of HMD>HMR and HMD>HMR+3σ are compared (Table 3 and FIG. 5).

TABLE 3

| Comparison | MM*1 | | HM*2 (N/mm$^2$) | | |
|---|---|---|---|---|---|
| sample | T | CR | T50 | CR50 | CR + 3σ |
| EMB. 4 | TME5 | CRME4 | 11 | 6 | 9.3 |
| COMP. EX. 3 | TME6 | CRME4 | 8 | 6 | 9.3 |

*1"MM" represents the manufacturing method. "T" is the toner, and "CR" is the charging roller. "TME5" is Toner Manufacturing Embodiment 5, "TME6" is Toner Manufacturing Embodiment 6, and "CRME4" is Charging Roller Manufacturing Embodiment 4.
*2"MH" represents the Martens hardness. "T50" is 50 point-average toner surface Martens hardness, "CR50" is 50 point-average charging roller surface Martens hardness, and "CR + 3σ" is a value of the sum of the 50 point-average charging roller surface Martens hardness and 3σ.

Figure 5:
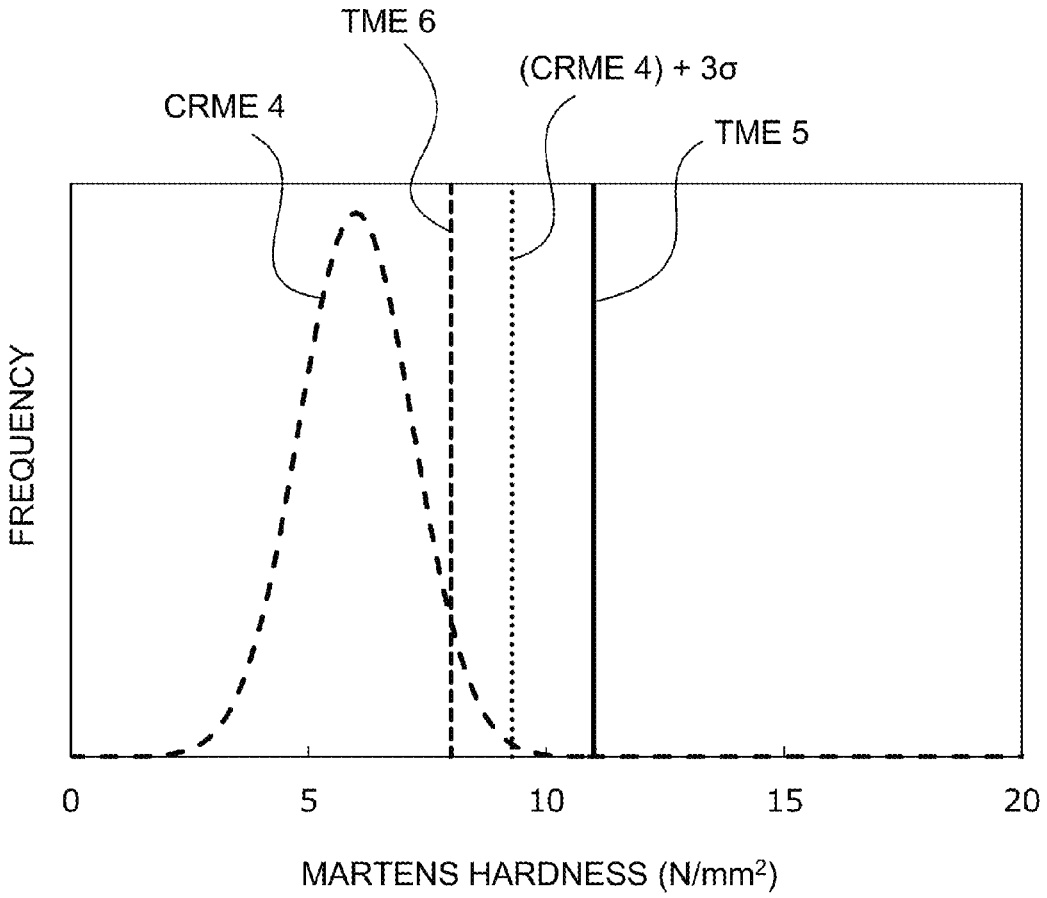
FIG. 5 is a graph for a comparison of Martens hardness in Embodiment 4 and Comparison Example 3.

Evaluation is made using the image forming apparatus similarly as in Embodiment 1. Constitutions of the charging roller and the toner which are used are shown in Table 3. A distribution of the Martens hardness is shown in FIG. 5.

In Embodiment 4, the evaluation is made using a charging roller of [Charging Roller Manufacturing Embodiment 4] as the charging roller and a toner of [Toner Manufacturing Embodiment 5] as the toner (Table 3). In [Toner Manufacturing Embodiment 5], the toner having the average value, of the toner Martens hardness, which is harder (larger) than the value of the sum of the charging roller hardness in [Charging Roller Manufacturing Embodiment 4] and 3σ is used. In Toner Manufacturing Embodiment 5, compared with Toner Manufacturing Embodiment 6, the toner is prototyped so that an aspect ratio of the toner is larger than that of the toner of Toner Manufacturing Embodiment 6. An irregular-shaped toner is soft in terms of the hardness, and therefore the toner high in aspect ratio consequently becomes a toner high in average of the hardness. The aspect ratio referred to herein means a ratio of a long side to a short side of toner particle.

Further, in Comparison Example 3, the evaluation was made using the charging roller of [Charging Roller Manufacturing Embodiment 5] as the charging roller and a toner of [Toner Manufacturing Embodiment 6] as the toner. In [Toner Manufacturing Embodiment 6], the toner having the average value, of the toner Martens hardness, which is softer (smaller) than the value of the sum of the charging roller hardness in [Charging Roller Manufacturing Embodiment 4] and 3σ is used.

Incidentally, in each of Comparison Example 3 in which the toner having the Martens hardness HMD (8 in Table 3) is used and Embodiment 4 in which the toner having the Martens hardness HMD (11 in Table 3) is used, the toner having the Martens hardness harder than the Martens hardness HMR of the charging roller of [Charging Roller Manufacturing Embodiment 4] is used.

In this embodiment, as the toner Martens hardness HMD, samples consisting of n pieces of data $x_1, x_2, \ldots x_n$ are extracted. At this time, standard average (mean) is defined by the following formula 4. In this embodiment, the average of the toner Martens hardness MHD is calculated using 50 pieces of data and the following formula 4:

$$\bar{x} = \frac{1}{n}\sum_{i=1}^{n} x_i. \qquad \text{formula 4}$$

However, only from the above average, it is not understood that the data are distributed in what manner, and therefore dispersion indicating a range of a variation in these data is used. As this dispersion of the data, a standard deviation s(σ) obtained by calculating the mean square of a difference (deviation) between each data and the average and then by calculating the positive square root of the resultant value in order to indicate the positive square root in the same dimension as variables is used. The value (the square of the standard deviation) before the positive square root is calculated is referred to as dispersion $s^2$, and is defined by the following formula 5. In this embodiment, the standard deviation σ of the charging roller Martens hardness HMR is calculated using the following formula 5:

$$s^2 = \frac{1}{n}\sum_{i=1}^{n} (x_i - \bar{x})^2. \qquad \text{formula 5}$$

Here, 70% of the 50 pieces of the data was distributed within a range of the charging roller Martens hardness average ±(standard deviation) σ, 96% of the 50 pieces of the data was distributed within a range of the charging roller Martens hardness average ±2σ, and 100% of the 50 pieces of the data was distributed within a range of the charging roller Martens hardness average ±3σ. In this embodiment, values to be compared with the toner Martens hardness are those of up to the charging roller Martens hardness average+3σ (HMD>HMR+3σ). As a result, even when there is a variation in charging roller Martens hardness, it is possible to reduce the degree of the crack, lack and the like of the toner, and thus lifetime extension can be realized.

Toner Manufacturing Embodiment 5

The toner used in this embodiment is obtained using a toner particle manufacturing method including the following steps. The steps include a particle-forming step of forming particles of a polymerizable monomer composition, containing a polymerizable monomer, a colorant and a polyester resin material, in a first aqueous solvent containing a dispersion stabilizer A and a polymerizing step of obtaining toner particles by polymerizing the polymerizable monomer contained in the particles of the polymerizable monomer composition. In the toner, the polyester resin material has an acid value of 0.3 mgKOH/g or more and 1.5 mgKOH/g or less. The toner contains the polyester resin material in an amount of 5.0 weight % or more and 20 weight % or less on the basis of the polymerizable monomer composition, and the first aqueous solvent contains sodium chloride in an amount of 1.5 weight % or more and 5.9 weight % or less on the basis of the polymerizable monomer composition.

In the toner particle manufacturing method in the present invention, in order to obtain the toner particles with a high aspect ratio, it is important that the acid value of the polyester resin material is a low acid value and that the content of the polyester resin material is 5.0 weight % or more and 20 weight % or less on the basis of the polymerizable monomer composition. The reason therefor is not clear, but it would be considered that a dispersing property of the colorant in the polymerizable monomer composition in the particle-forming step and the polymerizing step is improved by incorporating the polyester resin material having the low acid value in a large amount and thus the particles in the polymerizable monomer composition are stabilized in the aqueous solvent. As a result, it would be considered that coalescence between the particles is suppressed and thus the toner particles having the high aspect ratio can be obtained.

On the other hand, when the polyester resin material having a high acid value is incorporated in a large amount, a particle size distribution becomes broad. It has been considered that the resin material conventionally incorporated in the polymerizable monomer has a high acid value and is easily oriented at an interface between aqueous phase and oil phase, and thus the particles are stabilized. However, when the high acid value polyester resin material is added in an excessively large amount, the dispersing property of the colorant in the polymerizable monomer composition is lowered, so that stability of droplets is impaired in some cases.

Therefore, the content of the low acid value polyester resin material may preferably be 5.0 weight % or more and 20 weight % or less. When the content is less than 5.0 weight %, the aspect ratio of the toner particles becomes insufficient. Even when the content exceeds 20 weight %, a further effect on the aspect ratio of the toner particles cannot be obtained and viscosity of the polymerizable monomer composition increases. For that reason, manufacturing stability unpreferably lowers in some cases.

Further, in order to suppress minute particles, it is important that in the toner particle manufacturing method in the present invention, the content of the low acid value resin material is controlled and the sodium chloride is contained in the aqueous solvent in the amount of 1.5 weight % or more and 5.9 weight % or less on the basis of the polymerizable monomer composition. By incorporating the sodium chloride in a large amount in the aqueous solvent, based on a salting-out effect thereof, it is possible to suppress dissolution of the polymerizable monomer from the particles of the polymerizable monomer composition into the aqueous solvent. When the polymerizable monomer is dissolved into the aqueous solvent, the dispersion stabilizer is deposited on the monomer, so that minute particles such as so-called emulsified particles are generated. Further, as a starting point, the emulsified particles cause the particles, of the polymerizable monomer composition, having a desired particle to be bonded to each other, so that coalescent particles are generated in some cases.

Therefore, the content of the sodium chloride may preferably be 1.5 weight % or more and 5.9 weight % or less on the basis of the polymerizable monomer composition. A conventional dispersion stabilizer generates a by-product salt in the aqueous solvent. However, the content is small for achieving the salting-out effect of the by-product salt. On the other hand, when an addition amount of the dispersion stabilizer is large, the toner particles having the desired particle size cannot be obtained, and therefore it is preferable that the sodium chloride is further added. When the content of the by-product salt and the further added sodium chloride is less than 1.5 weight %, the suppression of the minute particles becomes insufficient. Even when the content exceeds 5.9 weight %, a further suppressing effect on the minute particles cannot be obtained and the content of the sodium chloride remaining in the toner particles increases. For that reason, the toner charging property unpreferably lowers in some cases.

Further, the present invention may preferably include a step of mixing a second aqueous solvent with the particles, of the polymerizable monomer composition, obtained in the particle-forming step, and the second aqueous solvent contains a dispersion stabilizer B in an amount of 5.0 weight % or more and 40 weight % or less on the basis of the dispersion stabilizer A. By incorporating the dispersion stabilizer B in the above content in the second aqueous solvent, the dispersion stabilizer short during the particle formation can be suppressed, so that it becomes possible to obtain the toner particles having a further high aspect ratio. However, when the content of the dispersion stabilizer B is less than 5.0 weight % on the basis of the dispersion stabilizer A, a further aspect ratio improving effect is insufficient. On the other hand, when the content of the dispersion stabilizer B exceeds 40 weight %, the excessive dispersion stabilizer B tends to be deposited on a volatile monomer component of the polymerizable monomer during the polymerization to increase the minute particles, thus being unpreferable.

Further, in the present invention, as described above, by adding the sodium chloride in the first aqueous solvent, the content of the sodium chloride in the first aqueous solvent may preferably be adjusted.

Further, in the present invention, the dispersion stabilizer A may preferably prepared by mixing a calcium chloride aqueous solution and a sodium phosphate aqueous solution. From calcium chloride and sodium phosphate, as shown in the following formula 6, hydroxyapatite and the sodium chloride which is the by-product are generated. The hydroxyapatite is a preferred dispersion stabilizer for stabilizing the particles of the polymerizable monomer composition. Further, as the by-product salt, the sodium chloride is generated, so that the hydroxyapatite may preferably be used in the present invention also in order to achieve the salting-out effect for suppressing the minute particles.

$$6Na_3PO_4+10CaCl_2+2H_2O \rightarrow [Ca_3(PO_4)_2]3Ca(OH)_2+18NaCl+2HCl \quad \text{formula 6}$$

In the following, a material constitution and a manufacturing method for carrying out the present invention will be described in detail.

In the present invention, as the polymerizable monomer, a vinyl monomer capable of radical polymerization is used. As the vinyl monomer, it is possible to use a monofunctional monomer or a polyfunctional monomer.

As the monofunctional monomer, it is possible to cite styrene; styrene derivatives such as α-methylstyrene, β-methylstyrene, o-methylstyrene, m-methylstyrene, p-methylstyrene, p-methoxystyrene and p-phenylstyrene; acrylic polymerizable monomers such as methyl acrylate, ethyl acrylate, n-propyl acrylate, iso-propyl acrylate, n-butyl acrylate, dibutyl phosphate ethyl acrylate and 2-benzoiloxyethyl acrylate; methacrylic polymerizable monomers such as methyl methacrylate, ethyl methacrylate and dibutyl phosphate ethyl methacrylate; methylene aliphatic monocarboxylate; vinyl esters such as vinyl acetate and vinyl propionate; vinyl ethers such as vinyl methyl ether, vinyl ethyl ether and vinyl isobutyl ether; and vinyl ketones such as vinyl methyl ketone; vinyl hexyl ketone and vinyl isopropyl ketone.

Of these monomers, the polymerizable monomer may preferably include the styrene or the styrene derivative.

As the polyfunctional monomer, it is possible to cite diethylene glycol diacrylate, triethylene glycol diacrylate, tetraethylene glycol diacrylate, polyethylene glycol diacrylate, tetramethylolmethane tetramethacrylate, divinylbenzene and divinyl ether.

The above-described monofunctional monomers may be used singly or in combination of two or more species or in combination thereof with the above-described polyfunctional monomers. The polyfunctional monomers can also be used as a cross-linking agent.

As a polymerization initiator used in the present invention, an oil-soluble initiator and/or a water-soluble initiator is used. In a preferred example, the polymerization initiator has a half-life of 0.5-30 hours at a reaction temperature during polymerization reaction. Further, when the polymerization reaction is made in an addition amount of 0.5-20 weight parts per 100 weight parts of the polymerizable monomer, in general, a polymer having a maximum value between a molecular weight of 10,000 and a molecular weight of 100,000 is obtained, so that it is possible to obtain toner particles having proper strength and melting characteristic and therefore is preferable.

As the polymerization initiator, it is possible to cite azo or diazo polymerization initiators such as 2,2'-azobis-(2,4-dimethylvaleronitrile), 2,2'-azobisisobutylonitrile, 1,1'-azobis (cyclohexane-1-carbonitrile, 2,2'-azobis-4-methoxy-2,4-dimethylbaleronitrile and azobisisobutylonitrile; and peroxide polymerization initiators such as benzoil peroxide, t-butylperoxy 2-ethylhexanoate, t-butylperoxy pivalate, t-butylperoxy isobutylate, t-butylperoxy neodecanoate, methyl ethyl ketone peroxide, diisopropylperoxy carbonate, cumene hydroperoxide, 2,4-dichlorobenzoil peroxide and lauroyl peroxide.

In the present invention, in order to control a degree of polymerization of the polymerizable monomer, it is also possible to further add and use known chain transfer agent, polymerization inhibitor and the like.

In the present invention, the polyester resin material is in corporated in the polymerizable monomer composition. For the polyester resin material used in the present invention, it is possible to cite the following materials.

As a divalent acid component, it is possible to cite the following dicarboxylic acids and derivatives thereof. Examples thereof may include benzenedicarboxylic acids or anhydrides thereof or lower alkyl esters thereof such as phthalic acid, terephthalic acid and phthalic anhydride; alkyldicarboxylic acids such as succinic acid, adipic acid, sebacic acid and azelaic acid or anhydrides thereof or lower alkyl esters thereof; alkenylsuccinic acids or alkylsuccinic acids such as n-dodecenylsuccinic acid and n-dodecylsuccinic acid or anhydrides thereof or lower alkyl esters thereof; and unsaturated dicarboxylic acids such as fumaric acid, maleic acid, citraconic acid and itaconic acid or anhydrides thereof or lower alkyl esters thereof.

As a divalent alcohol component, it is possible to cite the following materials. Examples thereof may include ethylene glycol, polyethylene glycol, 1,2-propane diol, 1,3-propane diol, 1,6-hexane diol, neopentyl glycol, 1,4-cyclohexanedimethanol (CHDM), hydrogenated bisphenol A, bisphenol represented by the following formula (1), and derivatives thereof.

formula (1)

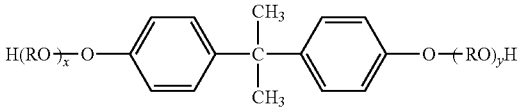

In the formula (1), R is ethylene or propylene group, and each of x and y is an integer of 0 or more with the proviso that an average of x+y is 0-10.

The polyester resin material usable in the present invention may also contain the following materials as a constituent component, in addition to the divalent carboxylic acid compound and the divalent alcohol compound which are described above. The constituent component may include a monovalent carboxylic acid compound, a monovalent alcohol compound, a trivalent or more carboxylic acid compound and a trivalent or more alcohol compound.

As the monovalent carboxylic acid compound, it is possible to cite aromatic carboxylic acids having 30 or less carbons such as benzoic acid and p-methylbenzoic acid; and aliphatic carboxylic acids having 20 or less carbons such as stearic acid and behenic acid.

Further, as the monovalent alcohol compound, it is possible to cite aromatic alcohols having 30 or less carbons such as benzyl alcohol; and aliphatic alcohols having 30 or less carbons such as lauryl alcohol, cetyl alcohol, stearyl alcohol and behenyl alcohol.

As the trivalent or more carboxylic acid compound, the material is not particularly restricted, but it is possible to cite trimellitic acid, trimellitic anhydride, pyromellitic acid and so on.

Further, as the trivalent or more alcohol compound, it is possible to cite trimethylolpropane, pentaerithritol, glycerin and so on.

The manufacturing method of the polyester resin material usable in the present invention is not particularly restricted, but a known method can be used.

In the present invention, a wax as a parting agent may also be incorporated in the polymerizable monomer composition.

As the wax, from the viewpoint of a high parting property, hydrocarbon waxes such as a low-molecular-weight polyethylene, low-molecular-weight polypropylene, microcrystalline wax and paraffin wax may preferably be used. As desired, waxes of two or more species may also be used in combination.

Specific examples of the wax may include:

VISCOL (registered trademark) 330-P, 550-P, 660-P, TS-200 (Sanyo Chemical Industries, Ltd.); HiWAX 400P, 200P, 100P, 410P, 420P, 320P, 220P, 210P, 110P (Mitsui Chemicals, Inc.); Sasol H1, H2, C80, C105, C77 (Schumann Sasol Ltd.); HNP-1, HNP-3, HNP-9, HNP-10, NHP-11, HNP-12 (Nippon Seiro Co., Ltd.); Unilin (registered tradename) 350, 425, 550, 700, Unicid (registered tradename) 350, 425, 550, 700 (TOYO ADL Corp.); Japan wax, beeswax, rice wax, candelilla wax, carnauba wax (available from CERARICA NODA Co., Ltd.).

As an addition amount of the wax, the wax may preferably be incorporated in an amount of 1.0 weight part or more and 20.0 weight parts or less per a binder resin.

Further, the toner particles in the present invention may be magnetic toner particles or non-magnetic toner particles.

In the case where the toner particles are manufactured as the magnetic toner particles, magnetic iron oxide may preferably be used as a magnetic material. As the magnetic iron oxide, magnetite, maghematite, ferrite and so on are used. An amount of the magnetic iron oxide contained in the toner may preferably be 25.0 weight parts or more and 100.0 weight parts or less per 100 weight parts of the binder resin.

In the case where the toner particles are manufactured as the non-magnetic toner particles, as a colorant, it is possible to use carbon black and other known pigments and dyes. Further, the pigments and the dyes may be used singly and can also be used in combination of two or more species. The amount of the colorant contained in the toner may preferably be 0.1 weight part or more and 60.0 weight parts or less, more preferably 0.5 weight part member and 50.0 weight parts or less, per 100 weight parts of the binder resin.

In the manufacturing method of the toner particles through the suspension polymerization, in addition to the above-described materials, known charge control agent, electroconductivity imparting agent, lubricant, abrading agent and so on may also be added.

The suspension polymerization toner particles are obtained in the following manner. The above additions are uniformly dissolved or dispersed to prepare a polymerizable monomer composition. Thereafter, this polymerizable monomer composition is dispersed in the aqueous solvent containing the dispersion stabilizer by using a proper stirring device, and as desired, an aromatic solvent and the polymerization initiator are added, and then the polymerizable monomer composition is subjected to the polymerization reaction to obtain the toner particles having a desired particle size.

After the polymerization is ended, the toner particles are filtered, washed and dried by known methods, and then as desired, inorganic fine powder is mixed as a flowability improving agent in the toner particles, so that the inorganic fine powder is deposited on the toner particles and thus the toner can be obtained.

As the inorganic fine powder, known inorganic fine powder is usable. The inorganic fine powder may preferably titania fine particles, silica fine particles such as wet-process silica and dry-process silica, and inorganic fine powder obtained by surface-treating these fine particles with a silane coupling agent, a titane coupling agent or a silicone oil or the like. The surface-treated inorganic fine powder may preferably have a degree of hydrophobization of 30 or more and 98 or less titrated by a methanol titration test.

<Means of Magnetic Material 1>

In a ferrous sulfate aqueous solution, a sodium hydroxide solution in an amount of 1.00-1.10 equivalent to iron element, $P_2O_5$ in an amount of 0.15 weight % expressed in terms of phosphor element relative to iron element, and $SiO_2$ in an amount of 0.50 weight % expressed in terms of silicon element relative to iron element were mixed. In this way, an aqueous solution containing iron hydroxide was prepared. The pH of the aqueous solution was adjusted at 8.0, and then oxidation reaction was made at 85° C. while blowing air into the aqueous solution, so that a slurry including seed crystal was prepared.

Then, into this slurry, the ferrous sulfate aqueous solution was added in an amount of 0.90-1.20 equivalent to an original alkali content (sodium component of the sodium hydroxide). Thereafter, the pH of the slurry was maintained at 7.6, and the oxidation reaction was caused to proceed while blowing the air into the slurry, so that the slurry containing magnetic iron oxide was obtained. After the slurry was filtered and washed, the resultant water-containing slurry was once taken out. At this time, a water-containing sample was taken in a small amount, and a water-containing amount was measured. Then, the water-containing sample was poured into another aqueous solvent without being dried, and then was dispersed again by a pin mill while stirring and circulating the slurry, so that the pH of the resultant dispersion was adjusted at 4.8. Then, into 100 parts of the magnetic iron oxide, n-hexytrimethoxysilane coupling agent was added in an amount of 1.6 parts while stirring the dispersion (in this case, the amount of the magnetic iron oxide was calculated as a value obtained by subtracting the water-containing amount from the water-containing sample), so that hydrolysis was made. Thereafter, the resultant dispersion was sufficiently stirred, and was subjected to surface treatment at the pH of 8.6. The thus-formed hydrophobic magnetic material was filtered by filter press, and was washed with a large amount of water. Thereafter, the magnetic material was dried at 100° C. for 15 minutes and then was dried at 90° C. for 30 minutes, and then the resultant particles were pulverized, so that magnetic material 1 of 0.21 μm in volume particle size was obtained.

<Means of Polyester Resin Material B1>

In a reaction vessel provided with a nitrogen introducing pipe, a dewatering pipe, a stirrer and a thermocouple, monomers in an amount of use shown in Table 4 below were placed, and thereafter dibutyltin was added as a catalyst in an amount of 1.5 weight parts per 100 weight parts in terms of a total amount of the monomers. Then, the mixture was quickly increased in temperature up to 180° C. at normal pressure in a nitrogen atmosphere, and thereafter water was distilled away while heating the mixture from 180° C. to 210° C. at a rate of 10° C./hour to perform polycondensation. After the temperature reaches 210° C., the pressure of an inside of the reaction vessel was reduced to 5 kPa or less, and the polycondensation was performed under a condition of 210° C. and 5 kPa or less, so that polyester resin material B1 was obtained. At that time, a polymerization time was adjusted so that a softening point of the resultant polyester resin material B1 become a value (125° C.) in Table 5 below. Physical properties of the polyester resin material B1 are shown in Table 5.

TABLE 4

| | Acid*2 (mol) | | | Alcohol*3 (mol) | | |
|---|---|---|---|---|---|---|
| Monomer | TPA | IPA | TMA | BPA-PO | BPA-EO | |
| PER*1 | B1 | 41 | 0 | 1 | 58 | 0 |

*1"PER" represents the polyester resin material.
*2"ACID" includes TPA (terephthalic acid), IPA (isophthalic acid) and TMA (trimellitic acid).
*3"Alcohol" includes BPA-PO (bisphenol A-propylene oxide (PO) 2 mol adduct) and BPA-EO (bisphenol A-ethylene oxide (EO) 2 mol adduct).

TABLE 5

| | Tg*2 (° C.) | SP*3 (° C.) | AV*4 (mgKOH/g) |
|---|---|---|---|
| PER*1 | 75 | 125 | 0.5 |

*1;"PER" represents the polyester resin material.
*2; "Tg" represents a glass transition temperature (point).
*3;"SP" represents the softening point.
*4;"AV" represents an acid value.

In the following procedure, toner particles and a toner were manufactured.

(Preparation of First Aqueous Solvent)

In 342.8 weight parts of ion-exchanged water, 3.1 weight parts of sodium phosphate dodecahydrate was added, and then the mixture was warmed to 60° C. while being stirred using T.K. homomixer (manufactured by PRIMIX Corp.). Thereafter, in the mixture, a calcium chloride aqueous solution obtained by adding 1.8 weight parts of calcium chloride dihydrate in 12.7 weight parts of ion-exchanged water and a sodium chloride aqueous solution obtained by adding 4.3 weight parts of sodium chloride in 14.5 weight parts of non-exchanged water were added, and then the resultant mixture was further stirred. Thus, a first aqueous solvent containing a dispersion stabilizer A was obtained.

(Preparation of polymerizable monomer composition)

| | |
|---|---|
| Styrene | 74.0 weight parts |
| n-butyl acrylate | 26.0 weight parts |
| 1,6-hexanediol diacrylate | 0.5 weight part |
| Aluminum salicylate compound ("E-101", manufactured by Orient Chemical Industries Co., Ltd.) | 0.5 weight part |
| Colorant: magnetic material 1 | 65.0 weight parts |
| Polyester resin material B1 | 20.0 weight parts |

The above materials were uniformly dispersed and mixed using an attritor (manufactured by Nippon Coke & Engineering Co., Ltd.), and were then warmed to 60° C. In the mixture, 15.0 weight parts of paraffin wax (DSC peak temperature: 80° C.) was added, mixed and dissolved, so that a polymerizable monomer composition was obtained.

(Preparation of Second Aqueous Solvent)

In 164.7 weight parts of ion-exchanged water, 0.9 wt. part of sodium phosphate dodecahydrate was added, and then the mixture was warmed to 60° C. while being stirred using a paddle stirring blade. Thereafter, in the mixture, a calcium chloride aqueous solution obtained by adding 0.5 weight part of calcium chloride dihydrate in 3.8 weight parts of ion-exchange water was added, and then the resultant mixture was further stirred, so that a second aqueous solvent containing a dispersion stabilizer B was obtained.

(Particle Formation)

In the first aqueous solvent, the above-obtained polymerizable monomer composition and 7.0 weight parts of t-butyl peroxypivalate as a polymerization initiator were added. Then, particles were formed at 60° C. in an atmosphere of $N_2$ while stirring the mixture at 12000 rpm for 10 minutes by the T.K. homomixer (manufactured by PRIMIX Corp.), so that a particle formation liquid containing droplets of the polymerizable monomer composition was obtained.

(Polymerization/Distillation/Drying/External Addition)

In the second aqueous solution, the above-obtained particle formation liquid was added, and the mixture was subjected to reaction at 74° C. for 3 hours while being stirred using the paddle stirring blade. After the reaction, the mixture was subjected to distillation at 98° C. for 3 hours, and then the resultant suspension was cooled. In the suspension, hydrochloric acid was added to wash the suspension, and then the suspension was filtered and dried, so that toner particles of 8.0 μm in weight-average particle size were obtained.

In 100 weight parts of the thus-obtained toner particles, the following materials were mixed by Henschel mixer ("FM-10", manufactured by Nippon Coke & Engineering Co., Ltd.), so that a toner 1 was obtained. Incidentally, a jacket of the Henschel mixer was temperature-adjusted to 45° C.

| | |
|---|---|
| Hydrophobic silica fine particles (primary particle number-average particle size: 20 nm) surface-treated with 25 weight % of hexamethyldisilazane | 0.5 weight part |
| Hydrophobic silica fine particles (primary particle number-average particle size: 110 nm) surface-treated with 15 weight % of hexamethyldisilazane | 0.5 weight part |

The above-obtained toner was 1.10 in particle size distribution (D50/D1), 0.930 in aspect ratio and 11 in Martens hardness HM.

The Martens hardness HM was measured as described in Embodiment 1.

Other physical properties were measured by the following methods.

<Measurement of Physical Properties of Toner>

(Measuring Method of Weight-Average Particle Size (D4)>

The weight-average particle size (D4) of the toner was measured in the following manner with the number of effective measurement channels of 25,000, and then analysis of measured data was made and thus the weight-average particle size (D4) was calculated. For measurement, a precise particle size distribution measuring device ("(Coulter-counter) Multisizer 3" (registered trademark, manufactured by Beckman Coulter K.K.) provided with a 100 μm-aperture tube and using a pore electrical resistance method, and an attached exclusive software ("Beckman Coulter Multisizer 3 Version 3.51, available from Beckman Coulter K.K.) for setting a measuring condition and analyzing measured data were used.

As an electrolytic aqueous solution used for measurement, an aqueous solution obtained by dissolving special-grade sodium hydrochloride in ion-excharged water so as to have a concentration of about 1 weight %, e.g., "ISOTON II" (manufactured by Beckman Coulter K.K.) can be used.

Incidentally, before performing the measurement and the analysis, setting of the exclusive software was made in the following manner.

In a "screen for changing standard operating method (SOM)" of the excluding software, the total count number in an operation in a control mode is set at 50,000 particles, the number of measurement is set at 1, and a Kd value is set at a value obtained using "standard particle 10.0 μm" (manufactured by Beckman Coulter K.K.). A threshold and a noise level are automatically set by pressing a measuring button for "threshold/noise level". Further, a current is set at 1600 μA, a gain is set at 2, the electrolyte solution is set at ISOTON II, and then "flush" of the aperture tube after the measurement is checked. Then, in a "setting screen for converting from pulse to particle size", a bin interval is set at a logarithmic particle size, a particle size bin is set at 256 particle size bins, and a particle size range is set at a range from 2 μm to 60 μm.

A specific measuring method is as follows.

1. In a glass-made 250 ml round-bottom beaker exclusive to the Multisizer 3, about 200 ml of the electrolytic aqueous solution is placed, and the flask is set on a sample stand, and measurement is made while stirring the aqueous solution by rotation of a stirrer rod in the counterclockwise direction at 24 rotations/sec. Further, contamination and air bubbles in the aperture tube are removed by the function of "aperture flush" of the analyzing software.

2. In a glass-made 100 ml flat-bottom beaker, about 30 ml of the electrolytic aqueous solution is placed. In the aqueous solution, about 0.3 ml of a diluted solution obtained by diluting, as a dispersing agent, "Contaminon N" (10 weight %-aqueous solution of a neutral detergent, for washing a precise measuring device, which contains a nonionic surfactant, an anionic surfactant and an organic builder and which has the pH of 7, manufactured by Wako Pure Chemical Industries, Ltd.) with 3 weight times with ion-excharged water is added.

3. Two oscillators each of 50 kHz in oscillating frequency are incorporated in a state in which phases thereof are derived from each other by 180 degrees. In a water tank of an ultrasonic dispersing device ("Ultrasonic Dispersion System Tetora 150", manufactured by Nikkaki Bias Co., Ltd.) with an electrical output of 120 W, a predetermined amount of ion-excharged water is placed. Then, in this water tank, about 2 ml of "Contaminon N" described above is added.

4. The beaker of 2. is set in a beaker fixing hole of the ultrasonic dispersing device, and then the ultrasonic dispersing device is actuated. Then, a height position of the beaker is adjusted so that a resonant state of a liquid surface of the electrolytic aqueous solution in the beaker becomes maximum.

5. In a state in which the electrolytic aqueous solution in the beaker of 4. is subjected to ultrasonic irradiation, about 10 mg of the toner is gradually added and dispersed in the electrolytic aqueous solution. Then, the ultrasonic dispersion is further continued for 60 sec. Incidentally, for the ultrasonic dispersion, a water temperature of the water tank is appropriately adjusted so as to be 10° C. or more and 40° C. or less.

6. In the round-bottom beaker of 1. set in the sample stand, the electrolytic aqueous solution of 5. in which the toner is dispersed is added dropwise using a pipe, so that a measuring density (concentration) is adjusted so as to be about 5%. Then, measurement is made until the number of measuring particles reaches 50,000 particles.

7. Analysis of measured data is made using the exclusive software attached to the measuring device, so that each of average particle sizes is calculated. When "graph/volume %" is set in the exclusive software, in an analysis/volume statistical screen, "arithmetic diameter" is the weight-average particle size D4, and "50% D diameter" is D50. Further, also the number-average particle size D1 is similarly calculated.

<Measuring Method of Aspect Ratio and Small Particle Ratio>

The circularity of the toner particles was measured by a flow-type particle image analyzer ("FPIA-3000", manufactured by Sysmex Corp.) under a measurement and analysis condition during a calibration operation.

A specific measuring method is as follows. First, about 20 ml of ion-excharged water from which an impurity solid matter is removed in advance is placed in a glass-made container (vessel). In the ion-excharged water, about 0.2 ml of a diluted solution obtained by diluting the "Contaminon N" with about 3 weight times with ion-excharged water is added. Further, about 0.02 g of a measuring sample is added and then is dispersed for 2 minutes using the ultrasonic dispersing device, so that a dispersion for measurement is prepared. At that time, the dispersion is appropriately cooled so that a temperature thereof is 10° C. or more and 40° C. or less. As the ultrasonic dispersing device, a desktop ultrasonic cleaning and dispersing device (e.g., "VS-150", manufactured by VELVO-CLEAR Co.) with an electrical output of 150 W is used, and in the water tank, a predetermined amount of ion-excharged water is placed and then about 2 ml of the "Contaminon N" is added.

For measurement, the above-described flow-type particle image analyzer in which an objective lens ("LUCPLFLN", magnification: 20, numerical aperture: 0.40) is mounted is used, and as a sheath liquid, a particle sheath ("PSE-900A", manufactured by Sysmex Corp.) was used. The dispersion prepared in accordance with the procedure described above is introduced into the flow-type particle image analyzer, 2000 toner particles are measured in an operation in an HPF measuring mode and a total count mode. Further, a binary threshold during particle analysis is set at 85%, and an analyzing particle size is limited to 1.977 μm or more and less than 39.54 μm in terms of a circle-equivalent diameter, so that the aspect ratio and a small particle ratio of the toner particles were obtained.

For measurement, autofocus adjustment using the following material is made before start of the measurement. That is, standard latex particles (e.g., "RESEARCH AND TEST PARTICLES Latex Microsphere Suspensions 5100A", manufactured by Duke Scientific Corp.) diluted with ion-excharged water is used for performing the autofocus adjustment. Thereafter, every two hours from start of the measurement, the focus adjustment may preferably be made.

Incidentally, in this embodiment, the flow-type particle image analyzer for which a calibration operation is made by Sysmex Corp. and for which a calibration certificate is issued from Sysmex Corp. was used. The measurement was performed under the same measuring and analyzing condition at the time when the calibration certification was made except that the analyzing particle size is limited to 1.977 μm or more and less than 39.54 μm in terms of the circle-equivalent diameter.

<Measurement of Tg of Resin>

The glass transition temperature Tg of the resin material is measured in accordance with ASTM D3418-82 using a differential scanning calorimetic analyzer ("Q2000", manufactured by TA Instruments Japan Inc. For temperature correction of a detecting portion of the device, melting points of indium and zinc are used, and for correction of heat quantity, heat of fusion of indium is used. Specifically, about 2 mg of a sample is accurately weighed and placed in an aluminum-made pan, and as a reference, a blank aluminum-made pan is used. Measurement is performed in a measuring temperature range of 30° C.-200° C. at a rate of temperature rise of 10° C./min. In the measurement, the temperature is once increased to 200° C. and is subsequently decreased to 30° C., and then is increased again. In this second temperature-increasing process, a change in specific heat is obtained in a temperature range of 40° C.-100° C. In this case, a point of intersection between a line, of an intermediate point of base lines before and after the change in specific heat, and a differential thermal curve is the glass transition temperature Tg of the resin material.

<Measurement of Softening Point of Resin>

Measurement of a softening point of the resin material is made using a capillary rheometer (flow characteristic evaluation device) ("Flow Tester CFT-500D", manufactured by Shimadzu Corp.) of a constant-load extrusion type in accordance with a manual attached to the device. In this device, a measuring sample charged in a cylinder is increased in temperature and melted while applying a constant load to the measuring sample from above by a piston, and then the melted measuring sample is extruded through a die at the bottom of the cylinder, so that a flow curve showing a relationship between a piston lowering amount and a temperature at that time can be obtained.

A "melting temperature in ½-method" described in the manual attached to the "Flow Tester CFT-500D" is the softening temperature. Incidentally, the melting temperature in ½-method is calculated in the following manner. First, ½ of a difference between a piston lowering amount Smax at the time of end of the extrusion and a piston lowering amount Smin at the time of start of the extrusion is obtained as X (=(Smax−Smin)/2). A temperature on the flow curve when the piston lowering amount on the flow curve is the sum of X and Smin is the melting temperature in the ½-method.

As the measuring sample, a cylindrical sample of about 8 mm in diameter obtained by compression molding of about 1.0 g of a sample at a pressure of about 10 MPa for about 60 seconds in an atmosphere of 25° C. by using a tablet compression molding machine (e.g., "NT-100H", manufactured by NPa System Co., Ltd.) is used.

A measuring condition of "CFT-500D" includes a test mode: temperature rise method, a temperature increasing ratio: 4° C./min., a start temperature: 50° C., and an arrival temperature: 200° C.

<Measurement of Acid Value of Resin>

The acid value of the resin material is the number of mg of potassium hydroxide required to neutralize an acid contained in 1 g of a sample. The acid value of the polyester resin material is measured in accordance with JIS K0070-1992, but is specifically measured in accordance with the following procedure.

(1) Preparation of Reagent

A phenolphthalein solution is obtained by dissolving 1.0 g of phenolphthalein in 90 ml of ethyl alcohol (95 vol. %) and then by adding ion-excharged water until a total amount reaches 100 ml.

In water, 7 g of special-grade potassium hydroxide is dissolved, and then ethyl alcohol (95 vol. %) is added until a total amount reaches 1 l. The solution is placed in an alkali-resistant container so as not contact carbon dioxide gas and the like, and is left standing for 3 days, and thereafter is filtered to obtain a potassium hydroxide solution. The thus-obtained potassium hydroxide is stored in the alkali-resistant container. A factor of the potassium hydroxide solution is obtained by adding 25 ml of 0.1 mol/1-hydrochloric acid and several droplets of the phenolphthalein solution and then by titrating the hydrochloric acid with the potassium hydroxide solution to obtain an amount of the potassium hydroxide solution required to neutralize the hydrochloric acid. The 0.1 mol/1-hydrochloric acid is prepared in accordance with JIS K8001-1998 and is used.

(2) Operation (A) Main Test

In a 200 ml-Erlenmeyer flask, 2.0 g of a pulverized polyester resin material sample is accurately weighed, and 100 ml of a mixture solution of toluene/ethanol (2:1) is added, so that the sample is dissolved in 5 hours. Then, as an indicator, several droplets of the phenolphthalein solution is added, and then the sample is titrated using the potassium hydroxide solution. Incidentally, an end point of the titration is the time when a pale pink color of the indicator continues for about 30 sec.

(B) Blank Test

The titration is made similarly as in the above operation except that the sample is not used (i.e., only the mixture solution of toluene/ethanol (2:1) is used).

(3) A result is substituted in the following formula 7, so that the acid value is calculated.

$$A=[(C-B)\times f\times 5.61]/S \qquad \text{formula 7}$$

Here, A is the acid value (mgKOH/g), B is an addition amount (mg) of the potassium hydroxide solution in the blank test, C is an addition amount (mg) of the potassium hydroxide solution in the main test, f is the factor of the potassium hydroxide solution, and S is an amount (g) of the sample.

Toner Manufacturing Embodiment 6

The toner in the present invention may also be a toner which is manufactured by a known pulverizing method and which is obtained by subjecting the pulverized product to a known surface treatment such as thermal spheroidizing treatment or a toner manufactured by a known polymerizing method.

In order to achieve the aspect ratio of the toner in the present invention, the above-described suspension polymerization may preferably be used.

| | |
|---|---|
| Styrene-acrylic copolymer (weight ratio of styrene: n-butyl acrylate = 74.0:26.0, main-peak molecular weight Mp = 10,000) | 100 weight parts |
| Magnetic material 1 | 90 weight parts |
| Aluminum salicylate compound ("E-101", manufactured by Orient Chemical Industries Co., Ltd.) | 0.5 weight part |
| Paraffin wax (Maximum heat absorption peak temperature: 80° C.) | 5 weight parts |

The above mixture was pre-mixed by the Henschel mixer, and thereafter was melt-kneaded by a biaxial extruder heated at 150° C. A cooled kneaded product was coarsely pulverized to obtain a coarsely pulverized product of a toner. The thus-obtained coarsely pulverized product was subjected to mechanical pulverization (fine pulverization) using a mechanical pulverizer ("Turbo Mill", mfd. by Freund-Turbo Corp., coating by plating with chromium alloy containing chromium carbide at surface of each of rotor and stator (plating thickness: 150 μm, surface hardness HV: 1050)). The resultant finely pulverized product was classified by a multidivision classifying device ("Elbow jet", manufactured by Nittetsu Mining Co., Ltd.) using Coanda effect, so that fine powder and coarse power were removed simultaneously.

Then, the classified product was thermally spheriodized. The thermal spheriodizing treatment was performed using "Surfusing System" (manufactured by Nippon Pneumatic Mfg. Co., Ltd.). An operating condition of a thermal spheriodizing device included feeding amount=5 kg/hr, hot air temperature C=260° C., hot air flow rate=6 $m^3$/min, cool air temperature E=5° C., cool air flow rate=4 $m^3$/min, cool air absolute water content=3 g/$m^3$, blower airflow rate=20 $m^3$/min, injection air flow rate=1 $m^3$/min, and diffusion air flow rate=0.3 $m^3$/min.

Toner particles were obtained by the surface treatment under the above condition. The weight-average particle size (D4) of the toner particles was 8.0 μm. In 100 weight parts of the obtained toner particles, the following materials were mixed by the Henschel mixer ("FM-10", manufactured by Nippon Coke & Engineering Co., Ltd.), so that toner 2 was obtained. Incidentally, a jacket of the Henschel mixer is temperature-adjusted to 45° C.

| | |
|---|---|
| Hydrophobic silica fine particles (primary particle number-average particle size: 20 nm) surface-treated with 25 weight % of hexamethyldisilazane | 0.5 weight part |
| Hydrophobic silica fine particles (primary particle number-average particle size: 110 nm) surface-treated with 15 weight % of hexamethyldisilazane | 0.5 weight part |

The above-obtained toner was 1.25 in particle size distribution (D50/D1), 0.900 in aspect ratio, 8.8% in small particle ratio and 8 in Martens hardness HM.

The physical properties were measured as described in [Toner Manufacturing Embodiment 5]. Further, the Martens hardness HM was measured as described in Embodiment 1.

Charging Roller Manufacturing Embodiment 4

1. Preparation of Unvulcanized Rubber Composition

A kneaded rubber composition A was obtained by mixing materials, having species and amounts shown in Table 6 below, by a pressurizing kneader. Then, 183.0 weight parts of the kneaded rubber composition A and materials having species and amounts shown in Table 7 below were mixed by an open roll, so that an unvulcanized rubber composition was prepared.

TABLE 6

| Material | weight part(s)*1 |
|---|---|
| EEATP*2 | 100.0 |
| Zinc oxide*3 | 5.0 |
| Calcium carbonate*4 | 60.0 |
| Carbon black*5 | 5.0 |
| Stearic acid | 1.0 |
| Aliphatic polyester-based plasticizer*6 | 10.0 |
| Perchloric acid quaternary ammonium salt*7 | 2.0 |

*1"weight part(s)" is weight part(s).

*2"EEATP" is epichlorohydrine-ethylene oxide-aryl glycidyl ether terpolymer (GECO) (trade name: "Epichlometer CG-102", manufactured by Daiso Chemical Co., Ltd.).

*3Two species of zinc oxide (manufactured by Seido Chemical Industry Co., Ltd.) were used.

*4Trade name: "Silver W", manufactured by Shiraishi Calcium Kaisha, Ltd.

*5Trade name: "Thermax (flow form) N990", manufactured by Cancarb Ltd.

*6Trade name: "Polycizer P202", manufactured by DIC Corp.

*7Trade name: "Adekacizer LV70", manufactured by ADEKA Corp.

TABLE 7

| | Material | weight part(s)*1 |
|---|---|---|
| CA*2 | Sulfur*3 | 0.8 |
| VA*4 | Dibenzothazoilsulfide*5 | 1.0 |
| VA*4 | Tetramethylthiuram monosulfide*6 | 0.5 |

*1"weight part" is weight part.
*2"CA" is a cross-linking agent.
*3Trade name: "Sulfax PMC", manufactured by Tsurumi Chemical Industry Co., Ltd.
*4"VA" is a vulcanizing accelerator.
*5Trade name: "Nocceler PM", manufactured by Ouchi Shinko Chemical Industrial Co., Ltd.
*6Trade name: "Nocceler TS", manufactured by Ouchi Shinko Chemical Industrial Co., Ltd.

2. Preparation of Electroconductive Elastic Roller

A round bar, of 252 mm in full length and 6 mm in outer diameter, which was subjected to electroless nickel plating at a surface of free-cutting steel was prepared. Then, an adhesive was applied onto the round bar through a full circumference in a range of 230 mm except for end portions each having a length of 11 mm. The adhesive was of a hot-melt type. The application was made using a roll coater. In this embodiment, the round bar on which the adhesive was applied was used as an electroconductive shaft core.

Then, a crosshead extruder including an electroconductive shaft core feeding mechanism and an unvulcanized rubber roller discharging mechanism was prepared, and dies each of 12.5 mm in inner diameter were attached to a crosshead. The extruder and the crosshead were adjusted to 80° C. in temperature, and a feeding speed of the electroconductive shaft core was adjusted to 60 mm/sec. Under this condition, the unvulcanized rubber composition was fed by the extruder and was coated as an elastic layer on the electroconductive shaft core in the crosshead, so that an unvulcanized rubber roller was obtained. Then, the unvulcanized rubber roller was placed in a hot-air vulcanizing furnace of 170° C. in temperature and was heated for 60 min., so that an unabraded electroconductive elastic roller was obtained. Thereafter, end portions of the elastic layer were cut and removed. Finally, the surface of the elastic layer was ground by a grindstone. As a result, the electroconductive elastic roller of 8.5 mm in diameter at a central portion was obtained. Incidentally, a crown amount (a difference in outer diameter between the central portion and a position of 90 mm apart from the central portion) of this roller was 110 μm.

3. Preparation of Coating Liquid 1

A coating liquid of a binder resin material for forming an electroconductive layer in the present invention was prepared by the following method.

In a reaction container, into 27 weight parts of polymeric MDI (trade name: "Millionate MR200", manufactured by Nippon Polyurethane Industry Co., Ltd.), 100 weight parts of polyester polyol (trade name: "P3010", manufactured by Kuraray Co., Ltd.) was gradually added dropwise. At this time, the polyester polyol was added dropwise while maintaining a temperature in the reaction container at 65° C. After, the dropwise addition, reaction was made at the temperature of 65° C. for 2 hours. The resultant reaction mixture was cooled to room temperature, so that an isocyanate-group-terminal prepolymer 1 having an isocyanate group content of 4.3% was obtained.

Then, 54.9 weight parts of the isocyanate-group-terminal prepolymer 1, 41.52 weight parts of polyester polyol (trade name: "P2010", manufactured by Kuraray Co., Ltd.) and carbon black ("MA230", manufactured by Mitsubishi Chemical Corp.) were dissolved in methyl ethyl ketone (MEK). Thus, the solution was adjusted so that a solid content was 27 weight %, so that a mixture solution 1 was prepared. In a 450 ml-glass bottle, 270 g of the mixture solution 1, 200 g of glass beads of 0.8 mm in average particle size were placed and then dispersed for 12 hours using a paint shaker (dispersing device). After the dispersion, in the dispersion (liquid), 320 weight parts of urethane particles ("Daimicbeaz UCN-5070D", manufactured by Dainichiseika Color & Chemicals Mfg. Co., Ltd.) of 7.0 μm in average particle size was added. Thereafter, the mixture was further dispersed for 15 min., and then the glass beads were removed, so that a surface layer coating liquid 1 was obtained.

4. Coating of Electroconductive Roller

Into the coating liquid 1 prepared by the method 3. described above, the electroconductive roller prepared in 2. was dipped one, and then was air-dried at 23° C. for 30 min. Then, the electroconductive roller was dried for 1 hour in a drying device with internal (hot) air circulation set at 80° C. and was further dried for 1 hour in the drying device set at 160° C., so that an electroconductive layer was formed on an outer peripheral surface of the electroconductive elastic roller. A dipping coating time was 9 sec., and a dipping coating raising speed was adjusted so that an initial speed was 20 mm/sec. and a final speed was 2 mm/sec. In a period from the speed of 20 mm/sec. to the speed of 2 mm/sec., the speed was linearly changed relative to a time.

The charging roller was manufactured by the above-described method. The 50-point average Martens hardness HM is 6. Further, a distribution of the Martens hardness of the charging roller at that time is as shown in FIG. 5.

<Durability Evaluation Result>

In an evaluation environment of 23° C. in temperature and 50% in humidity, 100 g of the toner was charged in the developing device, and printing of 5000 sheets of A4 in sheet size was effected with a print ratio of 1.5%, so that durability evaluation was made.

Comparison between results of Embodiment 4 and Comparison Example 3 was made by evaluation of fog (%) at 3000 sheets and at 5000 sheets, and the results are as shown in Table 8.

TABLE 8

| | | | Fog*3 | |
|---|---|---|---|---|
| Sample | Toner*1 | CR*2 | at 3000 | at 5000 |
| EMB. 4 | TIME 5 | CRME 4 | 4% | 5% |
| COMP. EX. 3 | TIME 6 | CRME 4 | 5% | 12% |

*1"Toner" means the associated Toner Manufacturing Embodiment.
*2"CR" means the associated Charging Roller Manufacturing Embodiment.
*3"Fog" means the fog. "at 3000" means the fog at 3000 sheets, and "at 5000" means the fog at 5000 sheets.

In Embodiment 4, a deterioration of the fog was not observed both at the durability evaluation sheet numbers of 3000 sheets and 5000 sheets. On the other hand, in Comparison Example 3, the fog was 5% at 3000 sheets, but was deteriorated to 12% at 5000 sheets.

Therefore, not only the average of the charging roller Martens hardness is made softer than the average of the toner Martens hardness, but also the distribution of the charging roller Martens hardness is obtained, and the +3σ value of the distribution is made softer than the average of the toner Martens hardness. As a result, when the charging roller in this embodiment is used, it is possible to reduce the degrees of the toner crack, the lacking and the like, so that lifetime extension can be realized.

OTHER EMBODIMENTS

The present invention may only be required to employ a constitution in which the degree of the deformation of the developer can be reduced by the charging member surface Martens hardness smaller than the developer surface Martens hardness. In the above, the cleaner-less constitution was described, but a constitution which is not the cleaner-less constitution may also be employed if the constitution satisfies the Martens hardness relationship described above.

Figure 6:
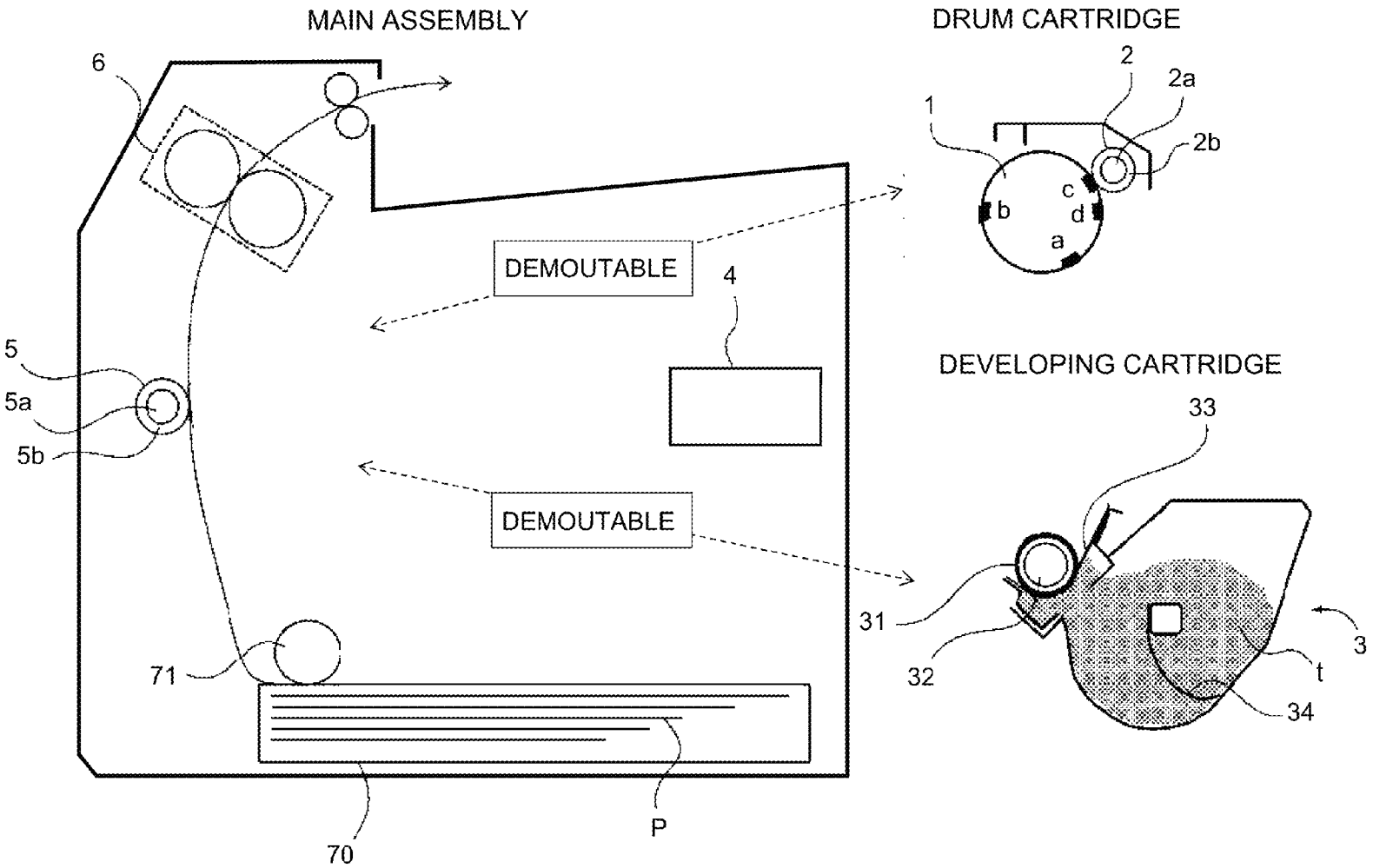
FIG. 6 is a schematic sectional view showing a structure of the image forming apparatus to which each of a drum cartridge and a developing cartridge is detachably mountable.

Further, to the image forming apparatus, detachably mountable various constitutions are applicable. For example, as shown in FIG. 6, each of a drum cartridge including a charging member and an image bearing member and a developing cartridge including developer carrying member may also be constituted so as to be detachably mountable to the image forming apparatus.

Further, such a constitution in which a toner cartridge in which the developer is accommodated is provided separately from the developing cartridge and is detachably mountable to the developing cartridge may also be employed. As another constitution, a constitution in which the toner cartridge is detachably mountable to the image forming apparatus main assembly may also be used. A constitution in which a process cartridge including the image bearing member, the charging member and the developing member is detachably mountable to the image forming apparatus main assembly may also be used.

While the invention has been described with reference to the structures disclosed herein, it is not confined to the details set forth and this application is intended to cover such modifications or changes as may come within the purpose of the improvements or the scope of the following claims.

This application claims the benefit of Japanese Patent Applications Nos. 2014-151312 filed on Jul. 25, 2014, 2014-241364 filed on Nov. 28, 2014 and 2015-128517 filed on Jun. 26, 2015, which are hereby incorporated by reference herein in their entirety.

What is claimed is:

1. An image forming apparatus comprising:

an image bearing member;

a charging member for electrically charging the image bearing member, the charging member being in contact with the image bearing member; and a developing member for supplying developer, the developing member being in contact with the image bearing member, wherein the developer remaining on the image bearing member after transfer is collected by the developing member, and wherein a Martens hardness HMR of a surface of the charging member and a Martens hardness HMD of a surface of the developer satisfy the following relationship:

$$HMD>HMR.$$

2. An image forming apparatus according to claim 1, wherein the Martens hardness of the surface of the charging member is 0.5 or more and 19 or less.

3. An image forming apparatus according to claim 1, wherein the Martens hardness of the surface of the charging member is 1 or more and 10 or less.

4. An image forming apparatus according to claim 1, wherein the Martens hardness of the surface of the developer is 2 or more and 50 or less.

5. An image forming apparatus according to claim 1, wherein the Martens hardness of the surface of the developer is 2.5 or more and 20 or less.

6. An image forming apparatus according to claim 1, wherein an arithmetic average roughness Ra of the surface of said charging member is 0.1 μm or more and 10 μm or less.

7. An image forming apparatus according to claim 1, wherein when a dispersion showing a range of a variation in Martens hardness of the surface of the charging member is σ, the following relationship is satisfied:

$$HMD>HMR+3\sigma.$$

8. An image forming apparatus according to claim 1, wherein the surface of the charging member is deformed so that the developer remaining on said image bearing member bites into the surface of the charging member at a contact position with the image bearing member.

9. An image forming apparatus according to claim 1, further comprising a developing blade for uniformly thinning a layer of the developer in contact with the developing member, wherein a contact position relationship is an order of a contact position between the image bearing member and the charging member, a contact position between the image bearing member and the developing member, and a contact position between the developing member and the developing blade from above with respect to a direction of gravity.

10. An image forming apparatus according to claim 1, wherein the charging member is a charging roller.

11. An image forming apparatus according to claim 1, wherein the developer is one component developer.

12. An image forming apparatus according to claim 11, wherein the developer is magnetic developer.

13. An image forming apparatus according to claim 1, wherein a rotational direction of the charging member is set as the same direction as a rotational direction of the image bearing member at a contact point between the image bearing member and the charging member.

14. An process cartridge detachably mountable to an image forming apparatus, the process cartridge comprising:

an image bearing member;

a charging member for electrically charging the image bearing member, the charging member being in contact with the image bearing member; and a developing member for supplying developer, the developing member being in contact with the image bearing member, wherein the developer remaining on the image bearing member after transfer is collected by the developing member, and wherein a Martens hardness HMR of a surface of the charging member and a Martens hardness HMD of a surface of the developer satisfy the following relationship:

$$HMD>HMR.$$

15. A process cartridge according to claim 14, wherein the Martens hardness of the surface of the charging member is 0.5 or more and 19 or less.

16. A process cartridge according to claim 14, wherein the Martens hardness of the surface of the charging member is 1 or more and 10 or less.

17. A process cartridge according to claim 14, wherein the Martens hardness of the surface of the developer is 2 or more and 50 or less.

18. A process cartridge according to claim 14, wherein the Martens hardness of the surface of the developer is 2.5 or more and 20 or less.

19. A process cartridge according to claim 14, wherein an arithmetic average roughness Ra of the surface of said charging member is 0.1 μm or more and 10 μm or less.

20. A process cartridge according to claim 14, wherein when a dispersion showing a range of a variation in Martens hardness of the surface of the charging member is σ, the following relationship is satisfied:

$$HMD > HMR + 3\sigma.$$

21. A process cartridge according to claim 14, wherein the surface of the charging member is deformed so that the developer remaining on said image bearing member bites into the surface of the charging member at a contact position with the image bearing member.

22. A process cartridge according to claim 14, further comprising a developing blade for uniformly thinning a layer of the developer in contact with said developing member, wherein a contact position relationship is an order of a contact position between the image bearing member and the charging member, a contact position between the image bearing member and the developing member, and a contact position between the developing member and the developing blade from above with respect to a direction of gravity.

23. A process cartridge according to claim 14, wherein the charging member is a charging roller.

24. A process cartridge according to claim 14, wherein the developer is one component developer.

25. A process cartridge according to 24, wherein the developer is magnetic developer.

26. A process cartridge according to claim 14, wherein a toner cartridge is detachably mountable to the process cartridge.

27. A process cartridge according to claim 14, wherein a rotational direction of the charging member is set as the same direction as a rotational direction of the image bearing member at a contact point between the image bearing member and the charging member.

28. A cartridge comprising:

an image bearing member on which developer is supplied to form a developer image; and a charging member for electrically charging the image bearing member, the charging member being in contact with the image bearing member, wherein a Martens hardness HMR of a surface of the charging member and a Martens hardness HMD of a surface of the developer satisfy the following relationship:

$$HMD > HMR.$$

29. A cartridge according to claim 28, wherein the Martens hardness of the surface of the charging member is 0.5 or more and 19 or less.

30. A cartridge according to claim 28, wherein the Martens hardness of the surface of the charging member is 1 or more and 10 or less.

31. A cartridge according to claim 28, wherein the Martens hardness of the surface of the developer is 2 or more and 50 or less.

32. A cartridge according to claim 28, wherein the Martens hardness of the surface of the developer is 2.5 or more and 20 or less.

33. A cartridge according to claim 28, wherein an arithmetic average roughness Ra of the surface of the charging member is 0.1 μm or more and 10 μm or less.

34. A cartridge according to claim 28, wherein, when a dispersion showing a range of a variation in Martens hardness of the surface of the charging member is σ, the following relationship is satisfied:

$$HMD > HMR + 3\sigma.$$

35. A cartridge according to claim 28, wherein the surface of the charging member is deformed so that the developer remaining on the image bearing member bites into the surface of the charging member at a contact position with the image bearing member.

36. A cartridge according to claim 28, wherein the charging member is a charging roller.

37. A cartridge according to claim 28, wherein a toner cartridge accommodating the developer is detachably mountable to the cartridge.

38. A cartridge according to claim 28, wherein a developing device including developer carrying member for carrying the developer is detachably mountable to the cartridge.

39. A cartridge according to claim 28, wherein the developer is one component developer.

40. A cartridge according to claim 39, wherein the developer is magnetic developer.

41. A cartridge according to claim 28, further comprising an image bearing member for bearing an image.

42. A cartridge according to claim 41, wherein a rotational direction of the charging member is set as the same direction as a rotational direction of the image bearing member at a contact point between the image bearing member and the charging member.

43. A cartridge according to claim 28, wherein the cartridge is detachably mountable to an image forming apparatus and a developing cartridge is detachably mountable to the image forming apparatus.

* * * * *